US010059476B2

(12) United States Patent
Parisini et al.

(10) Patent No.: US 10,059,476 B2
(45) Date of Patent: Aug. 28, 2018

(54) ASEPTIC FILLER FOR FLOWABLE PRODUCTS

(71) Applicant: John Bean Technologies S.p.A., Parma (IT)

(72) Inventors: Gianluca Parisini, Parma (IT); Glenna Matthews, Stockton, CA (US); Davide Ghiretti, Parma (IT); Michele Queirollo, Parma (IT); Antonio Aldini, Parma (IT); Dave Hoeppner, Parma (IT)

(73) Assignee: John Bean Technologies S.p.A., Parma (IT)

( * ) Notice: Subject to any disclaimer, the term of this patent is extended or adjusted under 35 U.S.C. 154(b) by 773 days.

(21) Appl. No.: 13/899,472

(22) Filed: May 21, 2013

(65) Prior Publication Data

US 2014/0345233 A1 Nov. 27, 2014

(51) Int. Cl.
*B65B 55/02* (2006.01)
*B65B 7/02* (2006.01)
(Continued)

(52) U.S. Cl.
CPC ..... *B65B 55/022* (2013.01); *B65B 3/045* (2013.01); *B65B 7/02* (2013.01); *B65B 31/024* (2013.01);
(Continued)

(58) Field of Classification Search
CPC .... B65B 3/045; B65B 3/16–3/18; B65B 3/36; B65B 7/02; B65B 7/04–7/12;
(Continued)

(56) References Cited

U.S. PATENT DOCUMENTS 3,310,078 A * 3/1967 Barrett ..... B65B 31/044 141/348
4,120,134 A * 10/1978 Scholle ..... B65B 43/54 141/114
(Continued)

FOREIGN PATENT DOCUMENTS

EP 0 088 735 A1 9/1983
EP 0 115 963 A1 8/1984
(Continued)

OTHER PUBLICATIONS

International Search Report and Written Opinion datedd Aug. 14, 2014, issued in corresponding International Application No. PCT/US2014/038835, filed May 20, 2014, 10 pages.

*Primary Examiner* — Stephen F Gerrity
*Assistant Examiner* — Joshua Kotis
(74) *Attorney, Agent, or Firm* — Christensen O'Connor Johnson Kindness PLLC

(57) ABSTRACT

An aseptic filler apparatus (30) includes an actuatable fitment plug assembly (500) that may be placed against the bottom of a fitment collar, which is in communication with a flexible bag to be filled with flowable food products, thereby to prevent steam or other gasses or liquids from entering the fill bag when undesirable to do so. The plug assembly (500) includes a plug (502) mounted on a distal end portion of a pivot arm (504). The opposite end of the pivot arm is rotatably axled on a cross pin. A linear actuator (518) is connected to the distal end of a lug (512) projecting transversely from the pivot arm. The opposite end of the linear actuator (518) is pinned to a stationary location, enabling the actuator to pivot the plug (502) from an engaged position against the fitment collar and a retracted position away from the fitment collar.

22 Claims, 19 Drawing Sheets

(51) Int. Cl.

| | |
|---|---|
| ***B65B 3/04*** | (2006.01) |
| ***B65B 31/02*** | (2006.01) |
| ***B65B 39/00*** | (2006.01) |
| ***B65B 39/10*** | (2006.01) |
| ***B65B 39/12*** | (2006.01) |
| ***B65B 55/10*** | (2006.01) |
| ***B65B 57/00*** | (2006.01) |

(52) U.S. Cl.
CPC ..... *B65B 39/004* (2013.01); *B65B 39/10* (2013.01); *B65B 39/12* (2013.01); *B65B 55/027* (2013.01); *B65B 55/10* (2013.01); *B65B 57/00* (2013.01)

(58) Field of Classification Search
CPC ..... B65B 31/02; B65B 31/024; B65B 31/044; B65B 39/002; B65B 39/003; B65B 39/004; B65B 39/005; B65B 39/06; B65B 39/10; B65B 39/12; B65B 55/022; B65B 55/025; B65B 55/027; B65B 2210/08
USPC ..... 53/468, 88, 109; 141/5, 51, 92; 422/300
See application file for complete search history.

(56) References Cited

U.S. PATENT DOCUMENTS 4,445,550 A 5/1984 Davis
4,446,674 A 5/1984 Inada
4,494,363 A * 1/1985 Rica ..... B65B 7/2878 53/109
4,498,508 A * 2/1985 Scholle ..... B65B 55/022 141/5
4,519,184 A * 5/1985 Brunswick ..... B65B 3/30 53/133.2
4,832,096 A * 5/1989 Kohlbach ..... B65B 39/04 141/114
4,916,885 A * 4/1990 Loliger ..... B65B 55/022 53/268
4,999,978 A * 3/1991 Kohlbach ..... B65B 55/022 141/114
5,099,895 A * 3/1992 Loeliger ..... B65B 55/022 141/63
5,106,595 A * 4/1992 Ellenberg ..... B65B 55/022 141/82
5,129,212 A * 7/1992 Duffey ..... B65B 55/022 141/10
5,447,699 A * 9/1995 Papciak ..... A61L 2/26 141/85
5,479,955 A * 1/1996 Roodvoets ..... B65B 55/022 137/15.16
5,860,461 A * 1/1999 Helmut ..... B65B 51/142 141/1
6,070,622 A * 6/2000 Rutter ..... B65B 39/004 141/10
6,330,780 B1 * 12/2001 Shipway ..... B65B 55/022 53/268
6,357,488 B1 * 3/2002 Brossard ..... B65B 55/022 141/1
7,690,171 B2 * 4/2010 Merusi ..... B65B 55/027 53/268
7,708,959 B2 * 5/2010 Savage ..... A61L 2/07 422/300

FOREIGN PATENT DOCUMENTS

EP 1 067 052 A1 1/2001
EP 2 028 108 A1 2/2009

* cited by examiner

ASEPTIC FILLER FOR FLOWABLE PRODUCTS

BACKGROUND

The present invention pertains to systems for aseptically packaging products in flexible containers or bags, and more particularly to aseptically filling flexible bags or containers fitted with standard fitments with various products, including food products, and in particular low acid content, flowable food products.

Currently, food products, and in particular low acid content flowable food products, are packaged in flexible bags in two primary ways. In a first way, flexible bags with standard fitments are positioned in a fill chamber to receive the food product routed to the fill chamber. The fill chamber is maintained in an overpressure condition to meet government regulatory requirements. The overpressure is designed to keep contaminants from entering the fill chamber. The overpressure is achieved through the use of sterile gas with chemicals designed to maintain the sterility of the fill chamber. However, when a standard fitment is opened and the interior of the bag exposed to the fill chamber, the pressure of the fill chamber may dramatically decrease due to the volume of the empty bag. To meet regulatory requirements, proof of positive pressure within the fill chamber is needed, and this is typically sought to be met by controlling and monitoring the flow of the sterile gas into the chamber.

In a second current method of aseptic packaging, customized or special fitments are utilized. As one example, the fitment may be closed off by a center membrane which keeps the overpressure gas in the fill chamber from entering the bag when the cap of the fitment is first removed. The fill tube is designed with a cutting nozzle that must cut through the membrane at the time of filling the bag. This is said to keep the interior of the bag from being exposed to the gas and/or chemicals used to maintain the overpressure condition in the fill chamber.

The present disclosure seeks to provide a system for aseptically filling flexible containers or bags employing standard fitments while maintaining a positive pressure in the fill chamber without the need for sterile gas and chemicals, but rather through the use of only steam.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An aseptic filler apparatus operates in a fill cycle to fill flexible bags with food products. A flexible bag is fitted with a fitment composed of a collar that is in food flow communication with the bag, as well as a removable cap engageable with the collar. The filler apparatus includes an enclosed filler chamber and a filler head disposed in the filler chamber to direct food products into the bag through the fitment. The apparatus also includes a fitment chamber in communication with the filler chamber, with the fitment chamber being substantially smaller in volume than the volume of the filler chamber. The apparatus in addition includes a holder assembly to hold the fitment within the fitment chamber, and includes a fitment plug assembly that is moveable between an actuated position to bear against the fitment collar to block food flow communication between the fitment collar and the bag during desired portions of the fill cycle, and a retracted position wherein the fitment plug is spaced away from the fitment collar to not hinder food flow communication between the fitment collar and the interior of the bag.

In a further aspect of the present disclosure, the fitment plug assembly is positioned externally of the fitment bag. Further, when the fitment plug assembly is in actuated position, a portion of the bag is interposed between the fitment collar and the fitment plug. In this manner, a positive seal is achieved between the fitment plug and the adjacent end of the fitment collar.

In a further aspect of the present disclosure, the fitment plug assembly includes a fitment plug shaped to close off the fitment collar when the fitment plug assembly is in actuated position, and an actuator assembly for moving the fitment plug between the actuated position and the retracted position of the fitment plug assembly. More specifically, the actuator assembly includes a pivot arm for supporting the fitment plug and an actuator for moving the pivot arm between the actuated position of the fitment plug assembly and the retracted position of the fitment plug assembly.

The disclosed filler apparatus also includes a fitment cap removal and replacement apparatus. Such apparatus is engageable with the fitment cap to remove the fitment cap from the fitment collar, and thereby provide access to the fitment collar during the filling of the bag by the filler head. The apparatus thereafter replaces the fitment cap into engagement with the fitment collar.

As a further aspect of the present disclosure, steam from a steam source is directed to the fitment chamber for sterilizing the fitment. Also, a steam removal system is provided for directing the steam from the fitment chamber.

The present disclosure also provides a method for filling a flexible bag with flowable food products at a filler station, wherein the filler station includes a filler head connectable to a source of flowable food product. The bag to be filled is flexible and is fitted with a fitment composed of a collar in food flow communication with the interior of the bag, and a cap for closing the collar. The method includes:

Placing a fitment in food flow communication with the fitment chamber located at a filler station;

Closing food flow communication between the fitment collar and the flexible bag;

Removing the fitment cap during closure of the food flow communication between the fitment collar and the bag;

Positioning the filler head in food flow communication with the fitment collar;

Reinstating the food flow communication between the fitment collar and the bag;

Directing the flowable food product to the fitment bag through the filler head and the fitment collar;

Closing food flow communication between the fitment collar and the bag;

Removing the filler head from food flow communication with the fitment collar;

Replacing the fitment cap on the fitment collar; and

Opening the food flow communication between the fitment collar and the bag.

In a further aspect of the present disclosure, the aseptic filling method includes applying a barrier against the fitment collar when closing off food flow communication between the fitment collar and the flexible bag.

In accordance with a further aspect of the present invention, the barrier is located exterior of the bag. In this regard, the barrier includes a fitment plug which can be placed against the fitment collar at the intersection of the fitment collar and the bag. The fitment plug is moveable between an engaged position when the fitment plug is disposed against the fitment collar, and a retracted position wherein the fitment plug is positioned away from the fitment collar.

In accordance with a further aspect of the present disclosure, steam is applied to the fitment chamber to sterilize the fitment prior to placing the filler head in food flow communication with the fitment collar.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 1-8 are side elevational views of a fill system of the present disclosure, illustrated in various stages of the fill cycle used to fill flexible containers with flowable work product, in particular flowable food products, wherein:

FIG. 1 shows the filler chamber of the fill system in ready condition;

FIG. 2 illustrates a fill bag in place with respect to the fill system, and with the cap of the fitment still in place and closing off the fill bag;

FIG. 3 illustrates the fitment cap being removed so as to provide access to the interior of the fill bag.

FIG. 4 shows the fitment cap removed and retracted away from the bag fitment;

FIGS. 5 and 6 illustrate the flexible bag being filled via a fill head extended downwardly to the fitment;

FIG. 7 illustrates the fitment cap being replaced to close off the filled bag;

FIG. 8 illustrates the completion of the filling of the bag and the detachment of the bag from the fill system;

FIGS. 9-20 are additional views of a fill system of the present disclosure, wherein:

FIG. 9 is a bottom view of the fill system, showing the construction of the fitment plug assembly;

FIG. 10 is an enlarged fragmentary view of a portion of FIG. 9 as indicated in FIG. 9;

FIG. 11 is a somewhat enlarged fragmentary elevational view of the fill chamber, fitment chamber, and fitment bag plug assembly in actuated position;

FIG. 12 is a fragmentary enlarged view of a portion of FIG. 11 as indicated in FIG. 11;

FIG. 13 is an enlarged fragmentary view of FIG. 2, showing in larger scale the filler chamber, the fitment chamber, and the fitment plug assembly;

FIG. 14 is an enlarged fragmentary view of FIG. 5, showing the filler head engaged with the fitment for filling the bag;

FIG. 15 is an elevational view of the fitment cap removal and replacement apparatus;

FIG. 16 is a bottom isometric view of FIG. 15;

FIG. 17 is an enlarged cross-sectional view of FIG. 15, taken from lines 17-17 thereof;

FIG. 18 is a view similar to FIG. 17, but with the fitment cap removal and replacement apparatus shown when in stowage position, either with or without the fitment cap engaged therewith;

FIG. 19 is an enlarged fragmentary view of the fitment holder assembly taken from the underside of the filler apparatus; and FIG. 20 is a view of the fitment holder assembly of FIG. 19, but viewed from the top of the fitment chamber.

DETAILED DESCRIPTION

Figure 1:
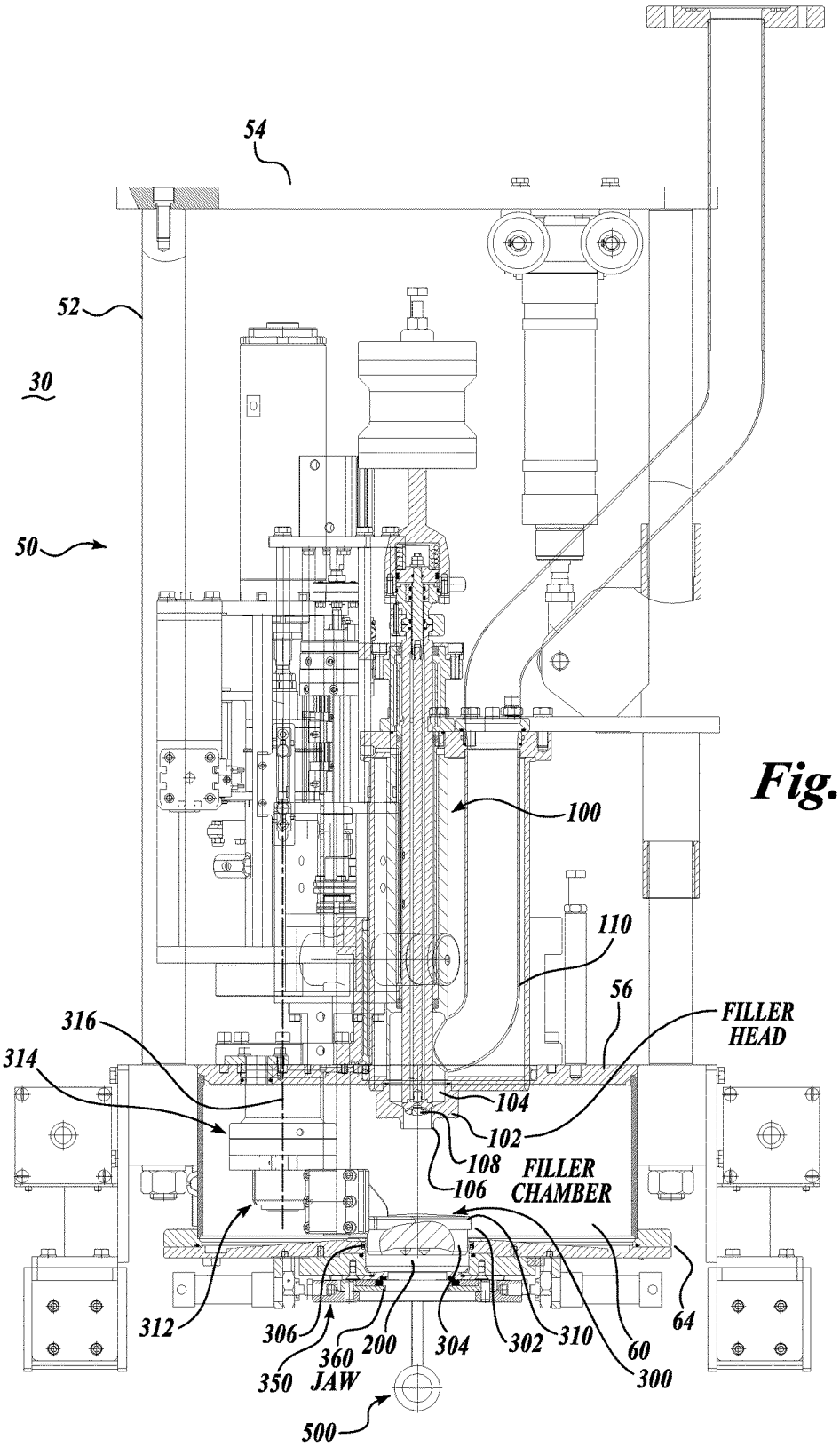

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

In the present application and claims, references to food products and flowable food products are meant to include all manner of food products, including liquid, flowable and solid food products and mixtures thereof, such as soups, sauces, purees, fruits, vegetables, nuts, etc., as well as beverages, juices, and other drinks.

Initially referring to FIGS. 1-8, 13 and 14, a filler apparatus 30 is illustrated for filling liquid or otherwise flowable food product into a flexible bag 400 under sterile (aseptic) conditions. The bag 400 includes a fitment (also referred to as "fitment closure") 402, composed of a fitment or fill collar or neck 408 closed by a cap 404. The fill collar 408 is attached to the bag 400 at the end of the collar opposite to the cap. The collar may include flanges 410, 412, 414, extending around and outwardly of the collar to define circular grooves such as groove 406 that extends around the collar 408. The bag itself is composed of a tough, flexible, single- or multi-layer material such as for example, polyethylene, nylon, aluminum foil and metalized polyester. The bags can be of a wide range of sizes, from as small as three gallons and up to over 300 gallons, or more and beyond. The collar 408 may be attached to the bag 400 by numerous different constructions as is known in the art. The cap 404 can also be of various constructions, including having a top portion 416 that overlaps a cylindrical portion 418. The cylindrical portion may be sized to closely fit within the inside and/or outside of the neck or collar 408.

Standard or common fitments are in use with flexible bags. The filler spouts are designed to accommodate such standard fitments. The present filler apparatus can be adapted to be used with nonstandard or unique fitments also.

The filler station or apparatus 30 in basic form includes a frame structure 50 that defines a filler chamber 60, maintained in an overpressure condition by a subtle gas, and preferably by steam. A filler head assembly 100 is extendible downwardly and retractable upwardly within the filler chamber. When extended downwardly, the filler head assembly 100 directs liquid food product to the flexible bag 400. During the fill process, the fill/fitment collar 408 is held stationary within a fitment chamber 200, located beneath the filler chamber 60 by a fitment holder assembly 350. The apparatus 30 also includes a fitment top or cap removal and replacement apparatus 450 to remove the fitment cap 404 from the fitment so that the bag can be filled, and then to replace the cap after the bag has been filled. Filler apparatus 30 in addition includes a plug assembly 300 for closing off the bottom of the filler chamber from the fitment chamber when the filler head is not being used to fill the bag 400.

The filler apparatus 30 further includes an actuatable fitment plug assembly 500 that may be placed against the bottom of the fitment collar to prevent steam or other gasses or liquids from the filler chamber to enter the bag 400 when undesirable to do so, and also to maintain an overpressure condition in the filler chamber when the cap 404 is removed from the collar 408. Otherwise, when the cap 404 is removed from the fitment collar 408, the filler chamber would be placed in communication with the entire volume of the empty bag, thereby reducing the pressure in the filler chamber to an unacceptable level, which can result in contamination entering the fill chamber. If the pressure is maintained within the fill chamber, then contamination will be prevented from entering the fill chamber.

Now referring more specifically to the different aspects of the filler apparatus 30, the frame structure 50 of the filler apparatus is composed in part of a plurality of upright posts 52 spanning between a top plate structure 54 and a bottom plate structure 56. The frame structure 50 may be carried by a support structure, not shown. The bottom plate structure 56 forms the top of the filler chamber 60. The filler chamber 60 is also formed by vertical side walls 62 and a floor plate structure 64 that engages the lower edges of the side walls 62. The filler chamber 60 is pressurized with a gas, preferably steam, thereby to prevent contaminants from entering the fill chamber and mixing with the flowable food product or from entering the container being filled. Thus, it is important to maintain the positive pressure within the fill chamber during the entire fill cycle.

Figure 3:
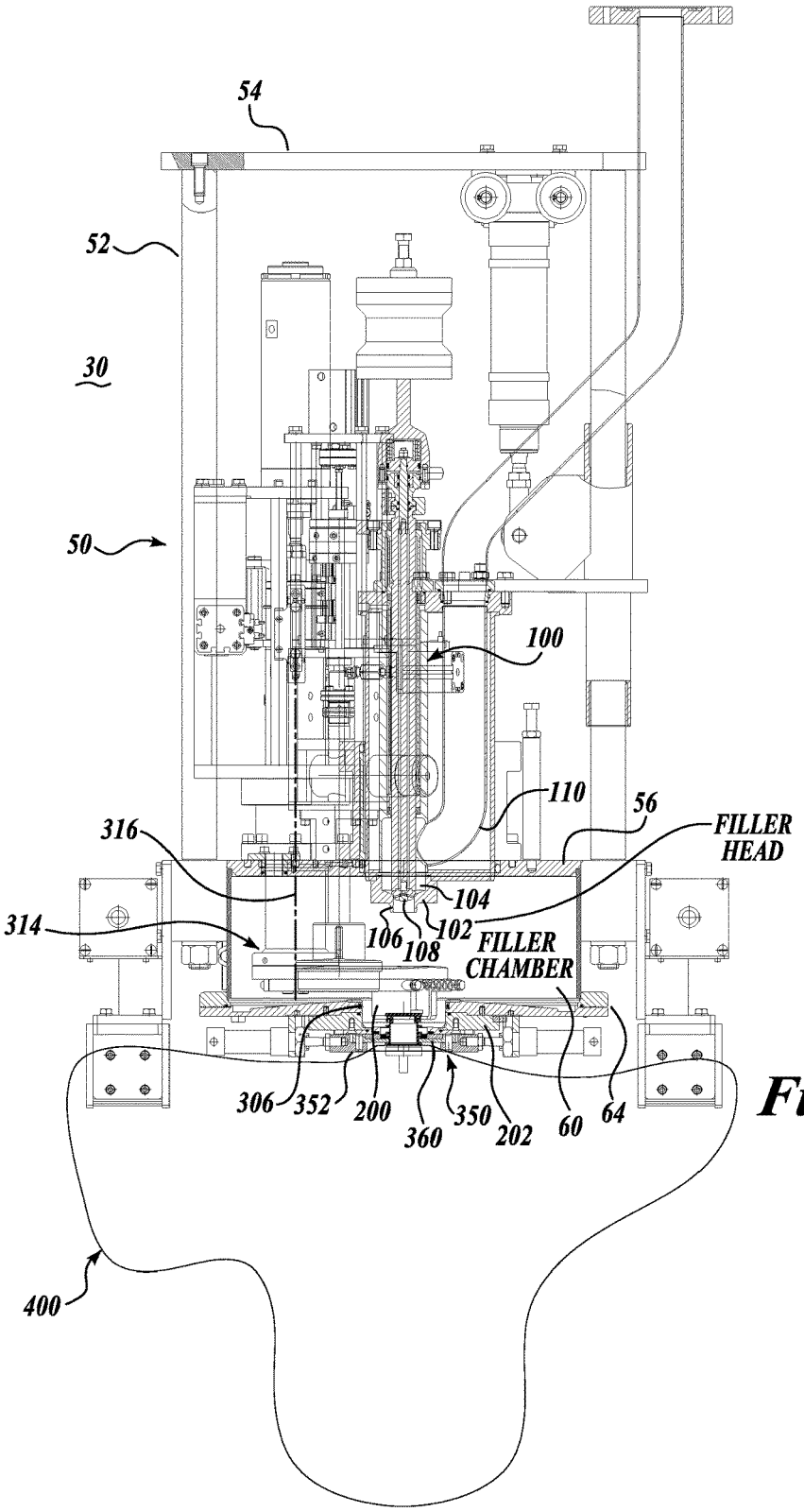
Figure 4:
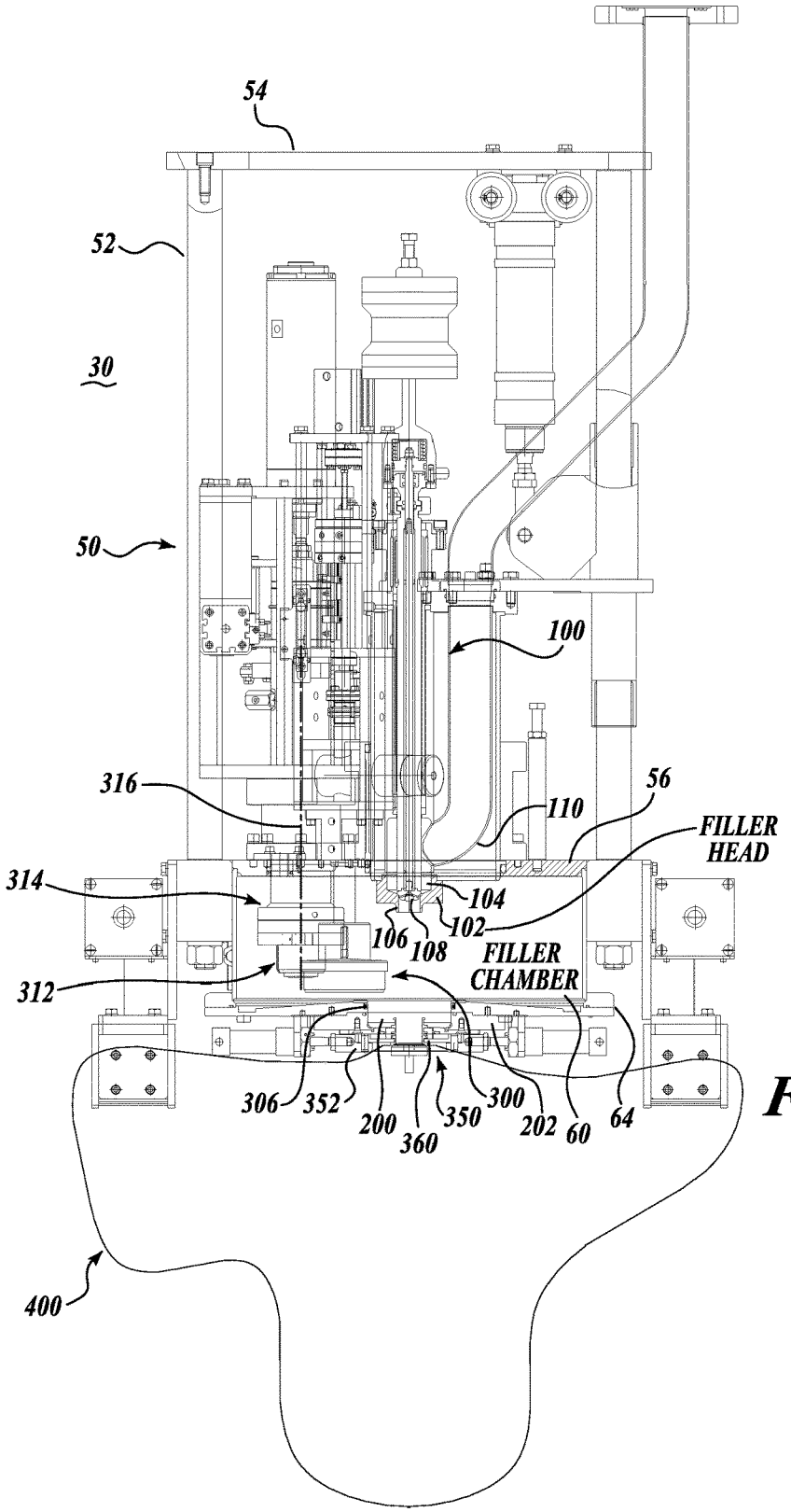
Figure 5:
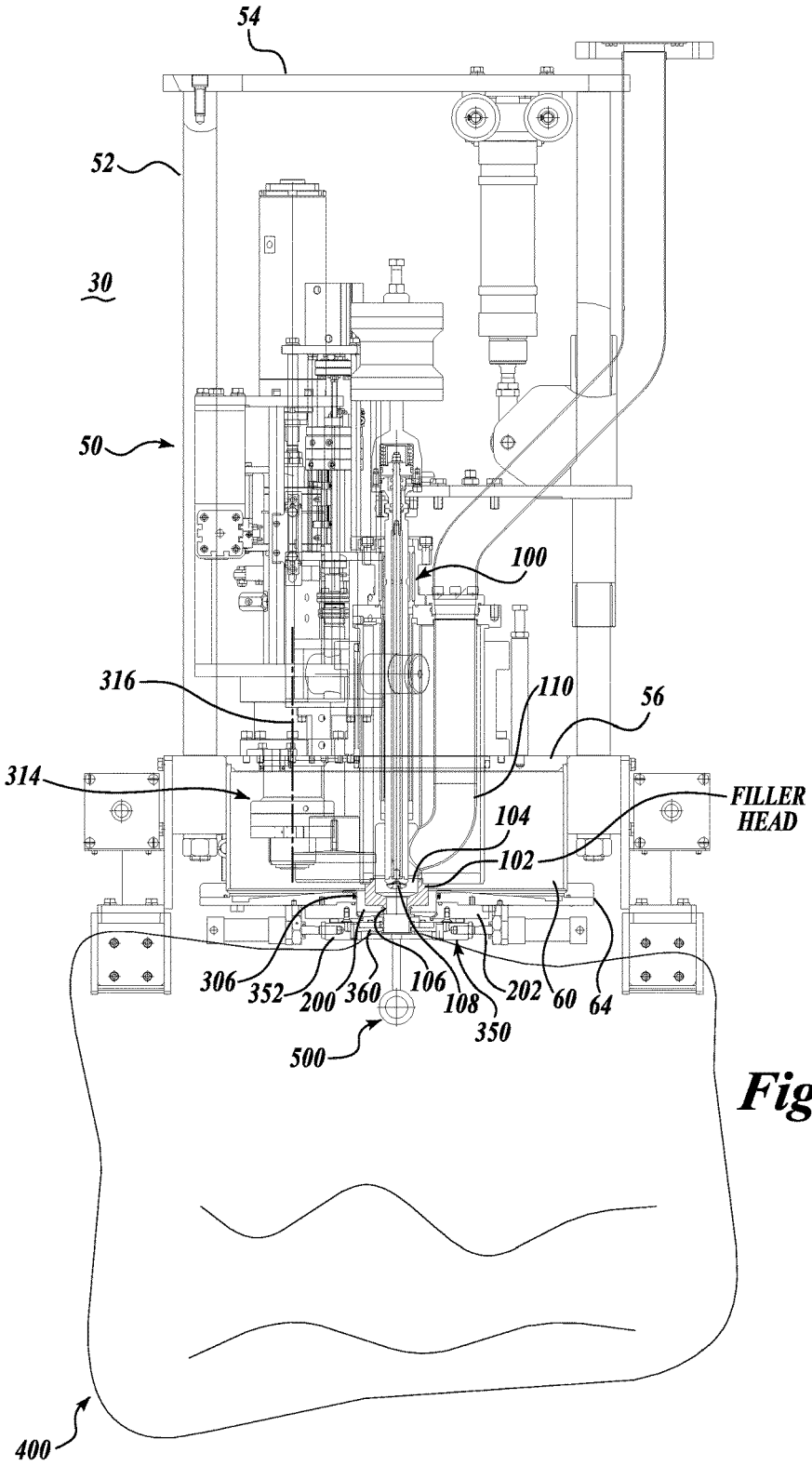
Figure 6:
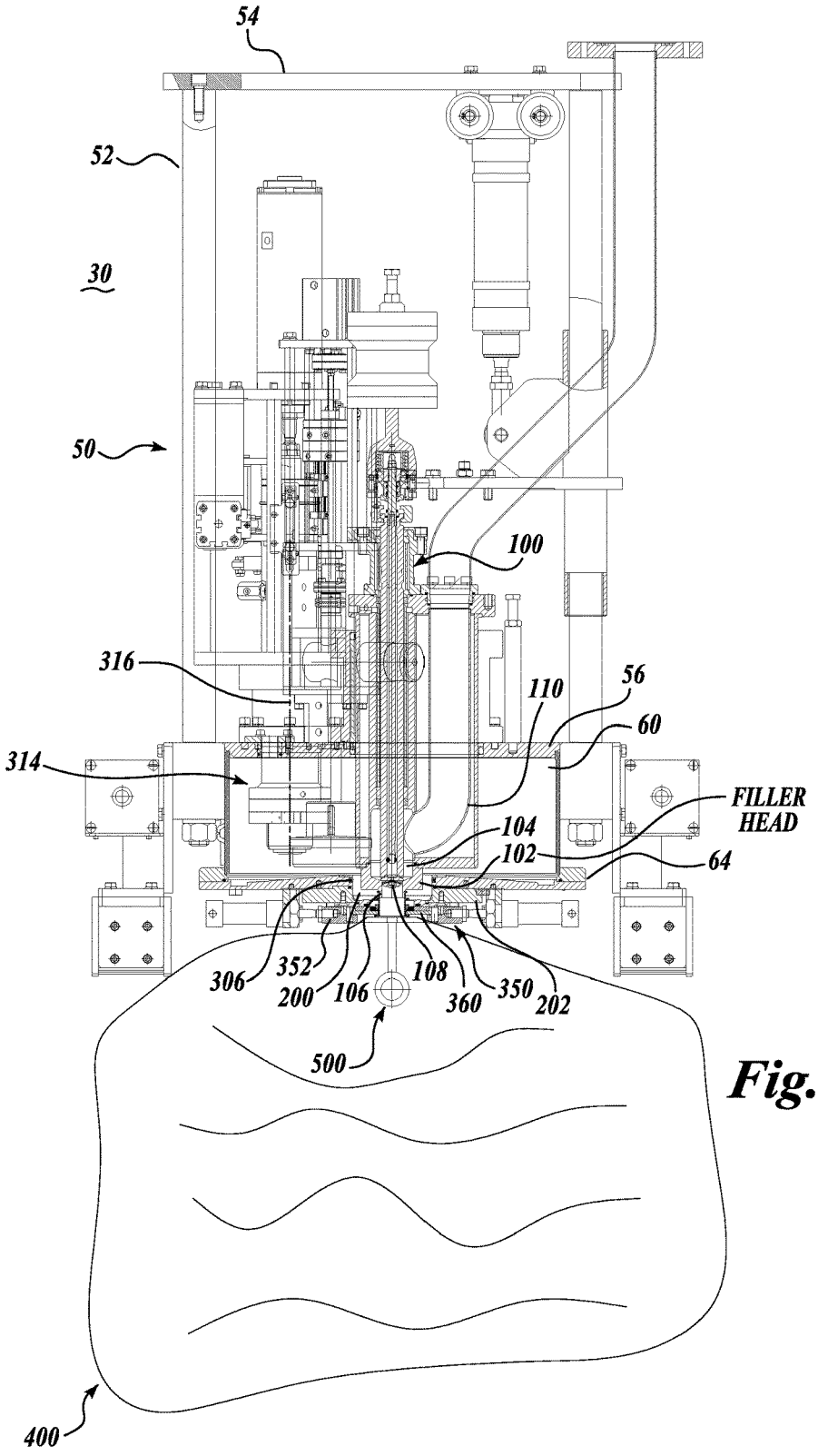

Filler head assembly 100 is shown in FIGS. 1-4, 7 and 8, in upward retracted position, and in FIGS. 5 and 6 in downward extended position. The filler head assembly 100 includes a leading head structure 102 defining an annular shaped cavity 104, and a downwardly extending nipple or tip 106. A valve 108 is positioned at the intersection of the cavity 104 and nipple 106 to open and close the head structure 102. A product inflow tube 110 intersects the head structure 102 to deliver liquid product into the cavity 104. The tube 110 is connected to a source of food product, not shown. The filler head assembly 100 is extended and retracted by an appropriate mechanism.

A central opening is formed in the floor plate structure 64 of the filler chamber 60. When desired, this opening is plugged or closed off by the plug assembly 300, which is shown in place in FIGS. 1, 2, and 8. In the remaining figures (FIGS. 3-7) the plug assembly 300 is removed from the floor plate structure and retracted away to the left side of the filler chamber.

Figure 2:
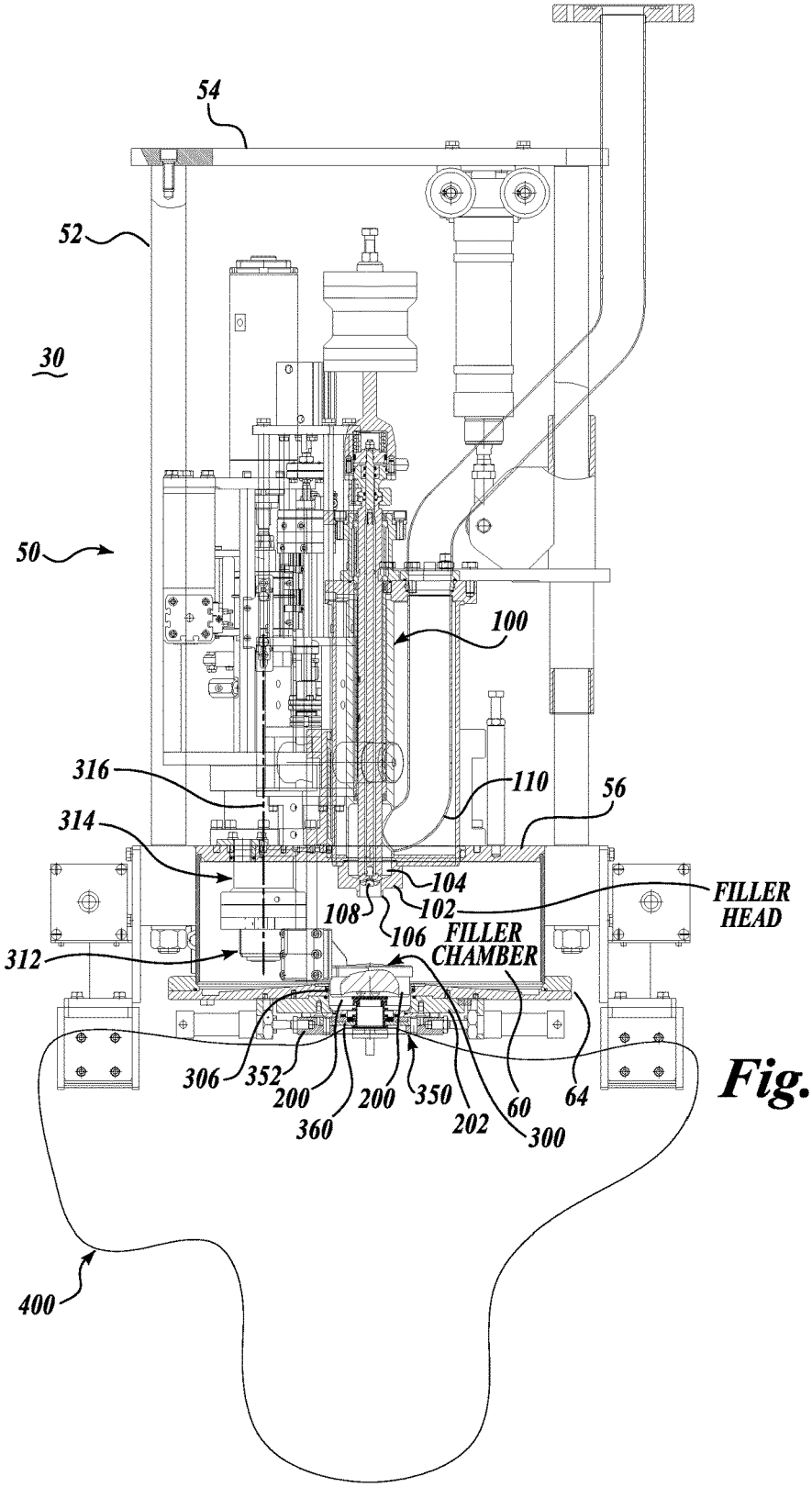

The plug assembly 300 includes a plug structure 302 composed of a plug body 304 that snugly engages within the central opening formed in the floor plate structure 64. A seal 306 is seated within a groove extending around the floor plate structure opening to seal against the plug body 304. The plug structure 302 includes a top 310 having a diameter somewhat larger than the diameter of the plug body 304. In FIG. 2, a portion of the plug structure 302 is broken away so that the construction of plug body 304 is visible. A bracket 312 connects the plug top to an actuator assembly 314 that is moveable vertically and also rotatable about a vertical axis 316. The actuator assembly 314 is extendable downwardly to engage the plug assembly into the floor plate structure hole, and also to retract the plug assembly upwardly to remove the plug assembly from the floor plate structure hole and then rotate the plug assembly away from the central portion of the fill chamber to a position on the left side of the fill chamber 60, as shown in FIGS. 3-7. The actuator assembly 314 is mounted on the frame structure 50 by appropriate brackets or other mounting structure.

Figure 13:
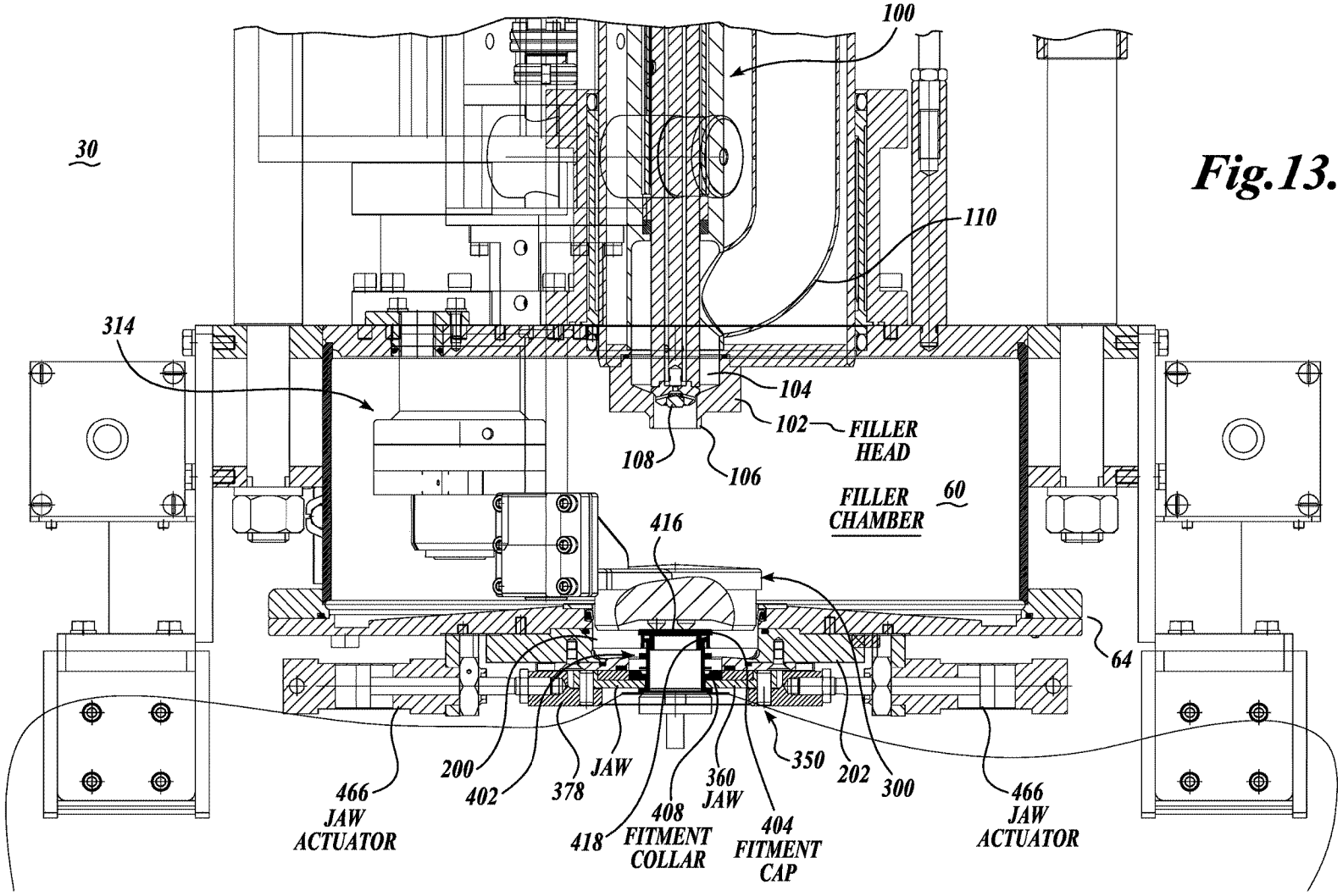
Figure 14:
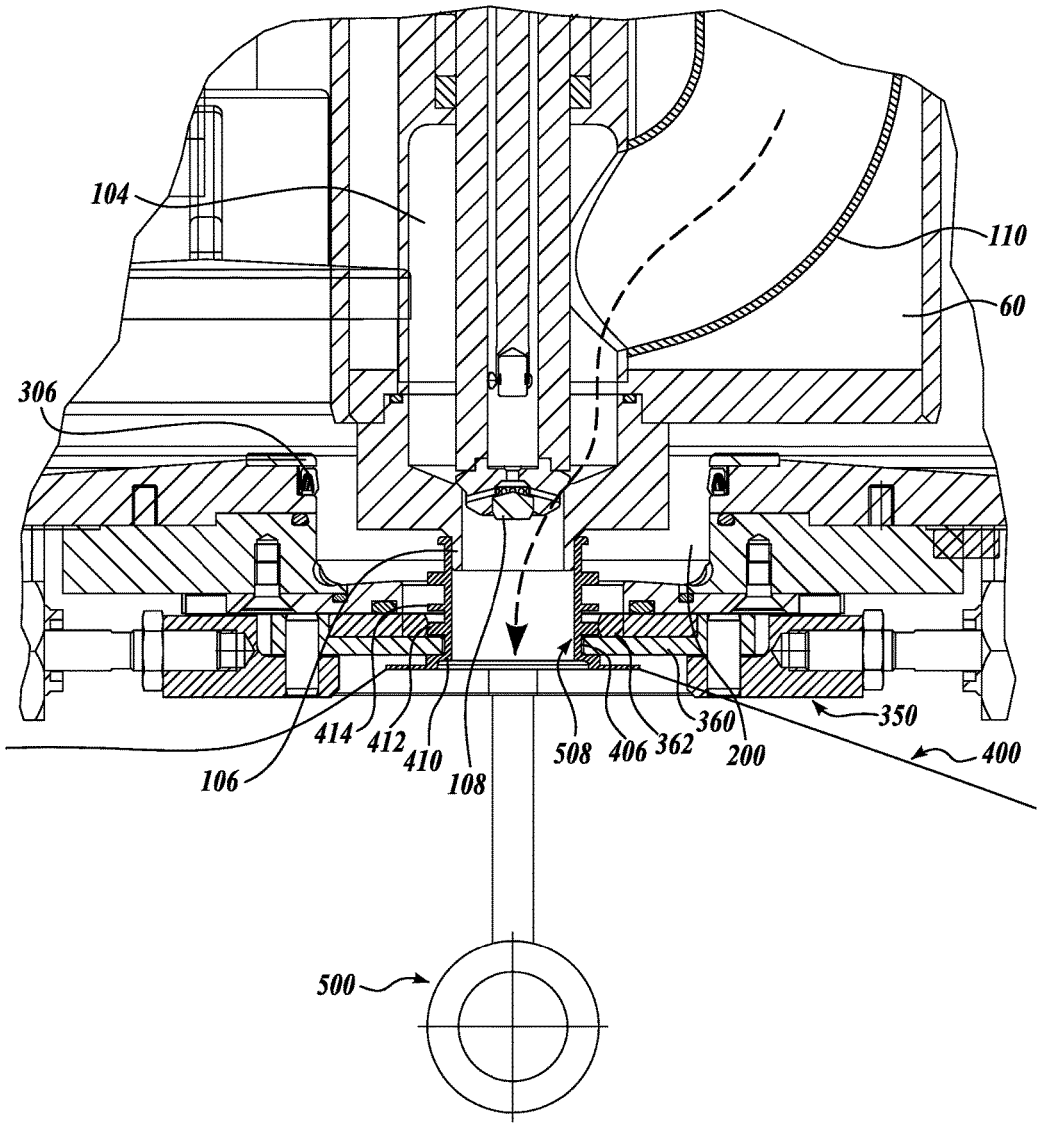
Figure 15:
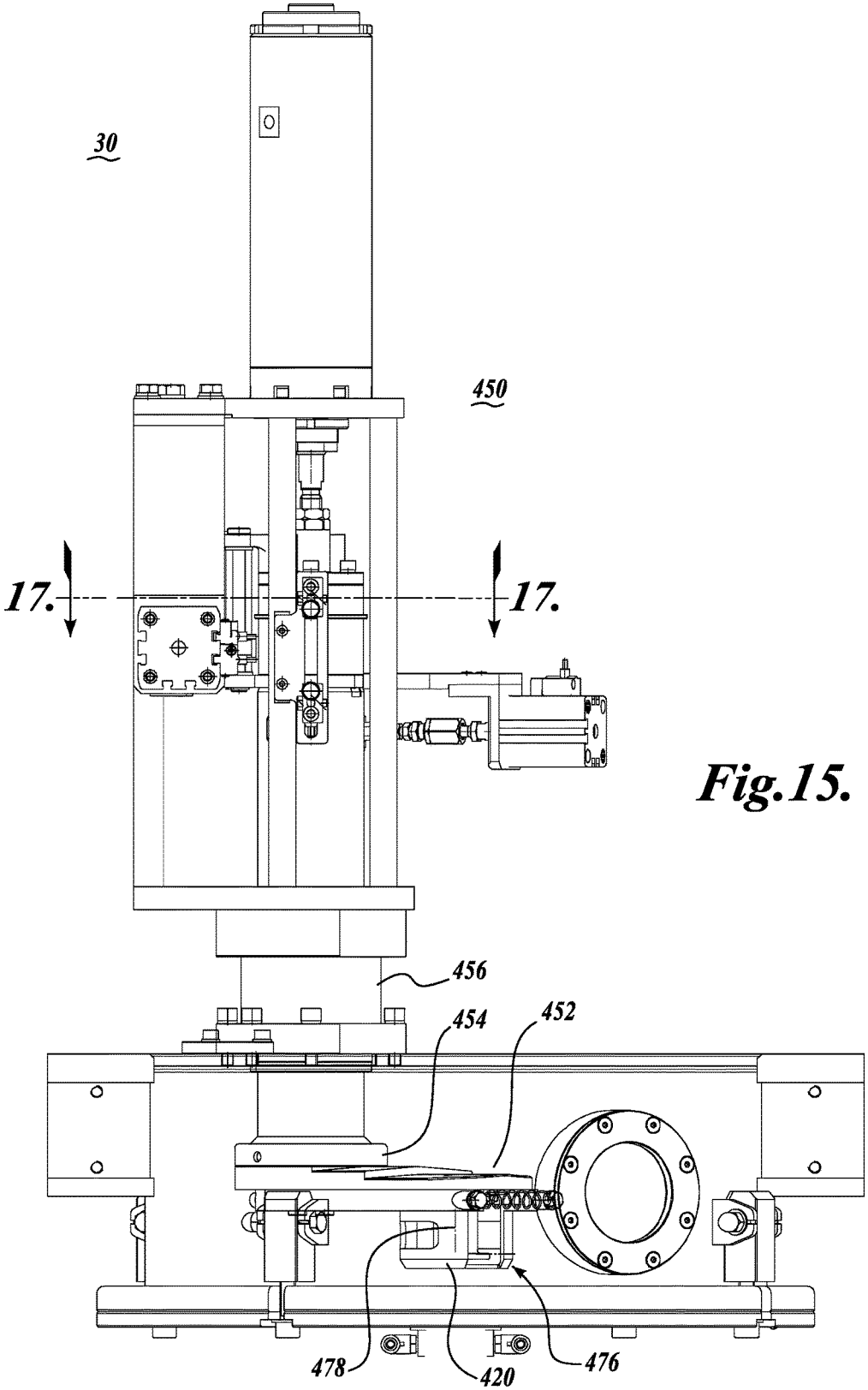

A fitment chamber 200 is positioned below the filler chamber 60. Enlarged views of the fitment chamber 200 are shown in FIGS. 13 and 14. The fitment chamber 200 is formed by the floor plate structure 64, as well as by a housing 202 that is attached to the underside of the floor plate structure. The housing 202 has a central cavity 204 of substantially the same diameter as the floor plate structure opening. A steam inlet line 206 and a steam outlet line 208 engage with passageways, not shown, formed in the housing 202 between the exterior perimeter of the housing and the central cavity 204. Control valves 210, 212, 214, and 216 control the flow of steam into and out of the cavity 204, as desired, for example, when sterilizing the fitment closure 402, as described below.

Figure 19:
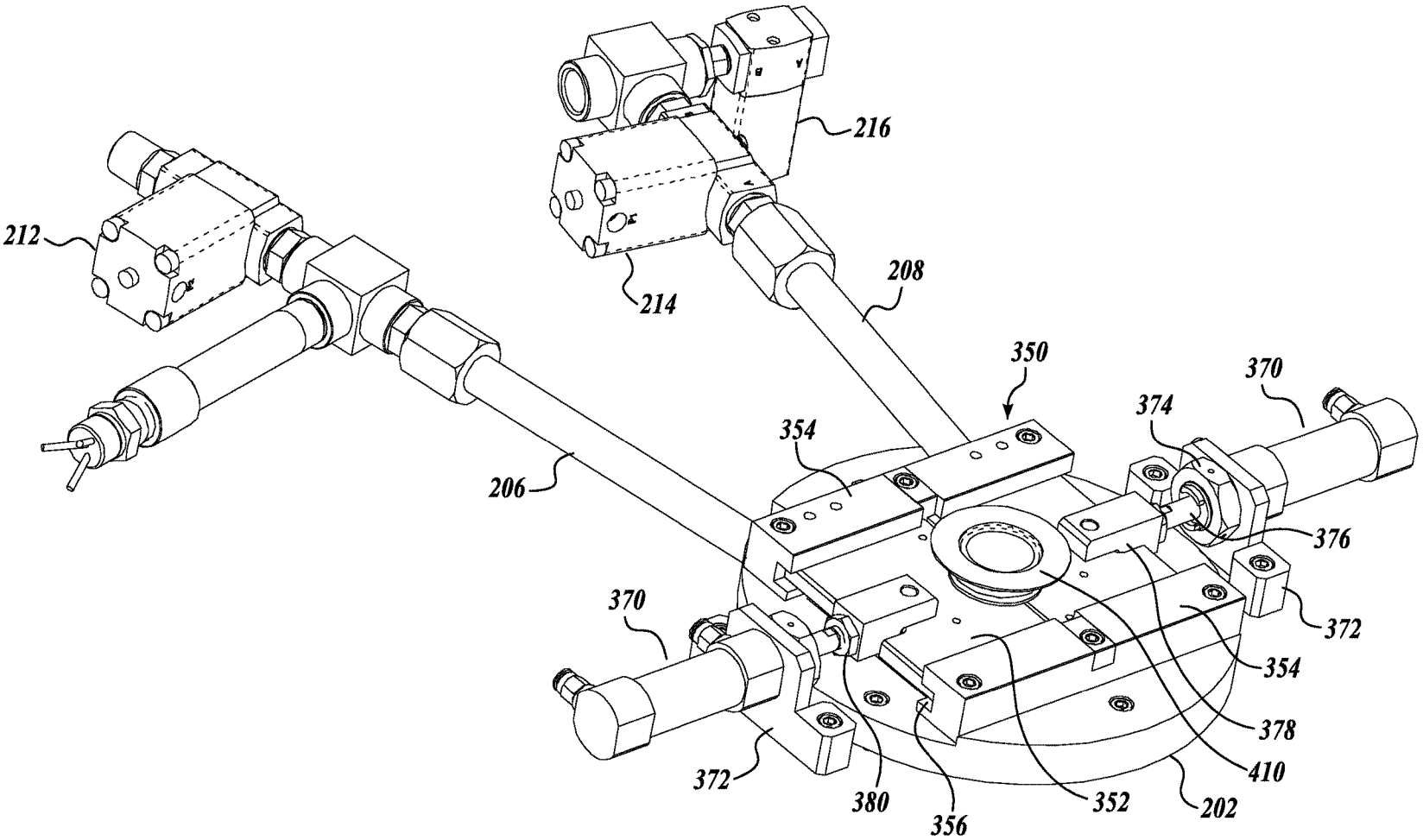
Figure 20:
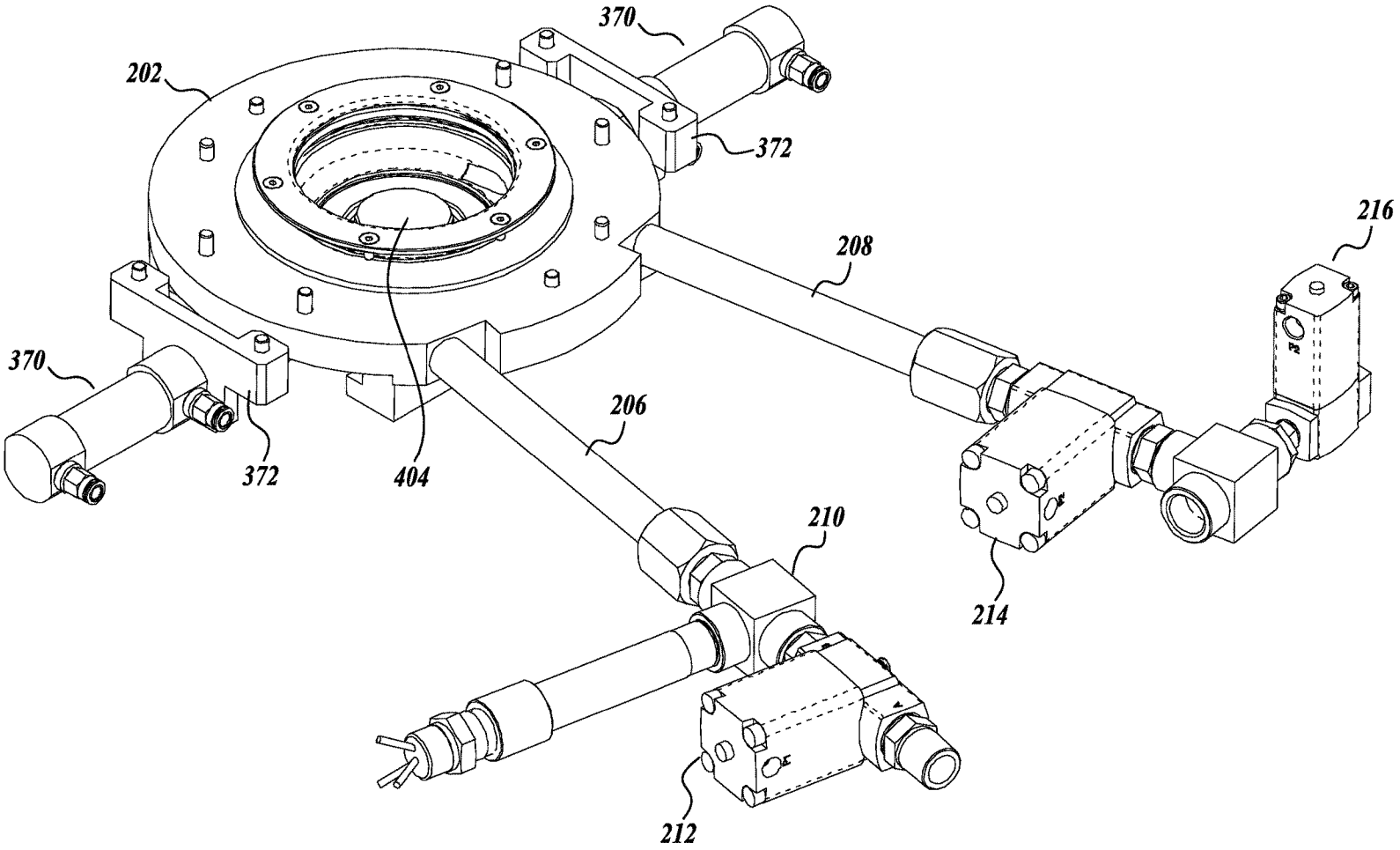

Referring to FIGS. 13 and 14, and also to FIGS. 19 and 20, a holder assembly 350 is employed to hold the fitment closure 402 in place during filling of the bag 400. The fitment holder assembly 350 is mounted to the underside of the fitment chamber housing 202. The fitment holder assembly 350 includes a pair of slide plates 352 that slide within spaced-apart parallel slideways 354 mounted to the underside of housing 202. The slideways 354 define longitudinal grooves 356 that closely receive the side edge portions of the slide plates 352. The center portions of the slide plates 352 cooperatively define a circular opening for receiving jaws 360 which is positioned within a shallow counter-bore formed in the slide plates. The jaws 360 are constructed of two halves, with a semi-circular central opening. As shown in FIGS. 13 and 14, the jaws 360 engage within a close-fitting groove 406 formed in the collar 408 of fitment 402. The groove 406 is formed by spaced-apart flanges 410 and 412 extending radially outwardly from the collar 408. The jaws 360 can be composed of any suitable material, for example, stainless steel or other metallic material, or other types of material, such as ceramic material.

An elastomeric seal 362 is located above jaw 360 to seal against the flange 412 that forms the upper side of the fitment groove in which the jaw 360 engages. The elastomeric seal 362 is backed by a backing ring 364 that overlies the jaws 360. The seal 362 is semi-circular in shape so as to cooperatively form a complete circular shape when the slide plates 352 are engaged around fitment 402.

The positions of the slide plates 352 are controlled by linear actuators 370 which may be powered by a gas, such as air, or a fluid, such as hydraulic fluid, in a well known manner. The actuators 370 are mounted to mounting brackets 372, which in turn are secured to the underside of floor plate structure 64, see FIGS. 13 and 19. The forward ends of linear actuators 370 extend through close-fitting openings formed in the mounting brackets 372, and are held in place by lock nuts 374 that engage with threaded collars extending forwardly from the forward end of the actuator bodies. The forward ends of actuator rods 376 are connected to anchor brackets 378, which in turn are secured to the corresponding portions of slide plates 352. To this end, the forward ends of the actuator rods 376 may be threaded to engage threaded bores formed in the brackets 378, with the rods 376 held in place by lock nuts 380. It will be appreciated that by the foregoing construction, a very reliable and robust structure is provided for the fitment holder assembly 350.

Once the fitment closure 402 is in place in the fitment chamber and being held by the fitment holder assembly 350, prior to filling the bag 400 the fitment cap 404 is removed.

However, as discussed more fully below, before the fitment cap is removed, the fitment 402 is sterilized by steam introduced into the fitment chamber 200 through a steam inlet line 206. During such sterilization of the fitment, the filler chamber plug assembly 300 is engaged in the fitment chamber opening formed in the floor plate structure 64, as shown in FIGS. 2 and 13.

Figure 7:
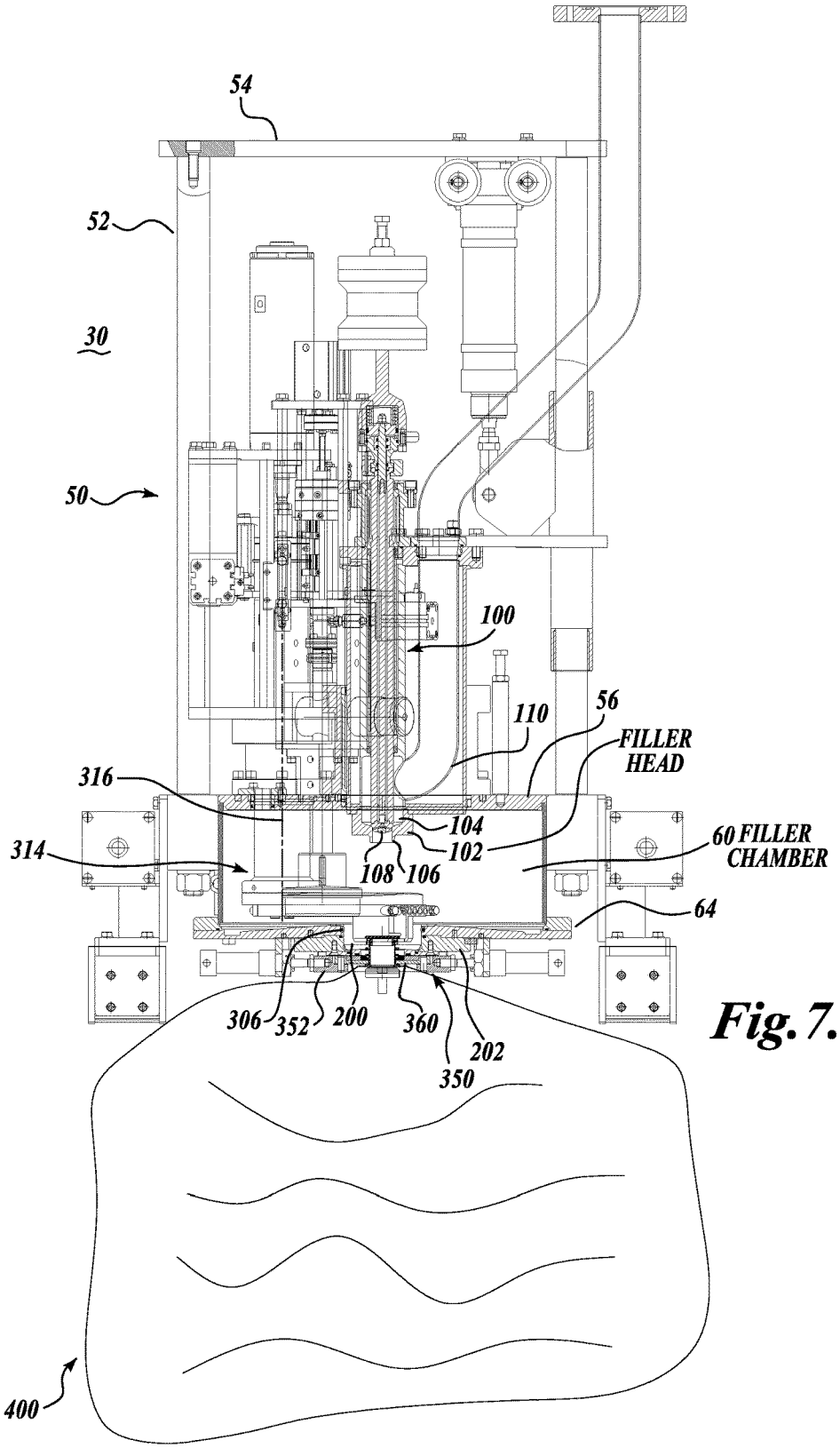

FIG. 3 illustrates the fitment cap removal/replacement apparatus 450 as engaged with the fitment cap 404. In FIG. 3, the fitment cap 404 is being removed from the fitment collar 408. FIG. 7 illustrates the fitment cap 404 being replaced over the fitment collar 408 after the bag 400 has been filled. FIGS. 15-18 show additional views of the fitment cap removal and replacement apparatus 450.

Figure 16:
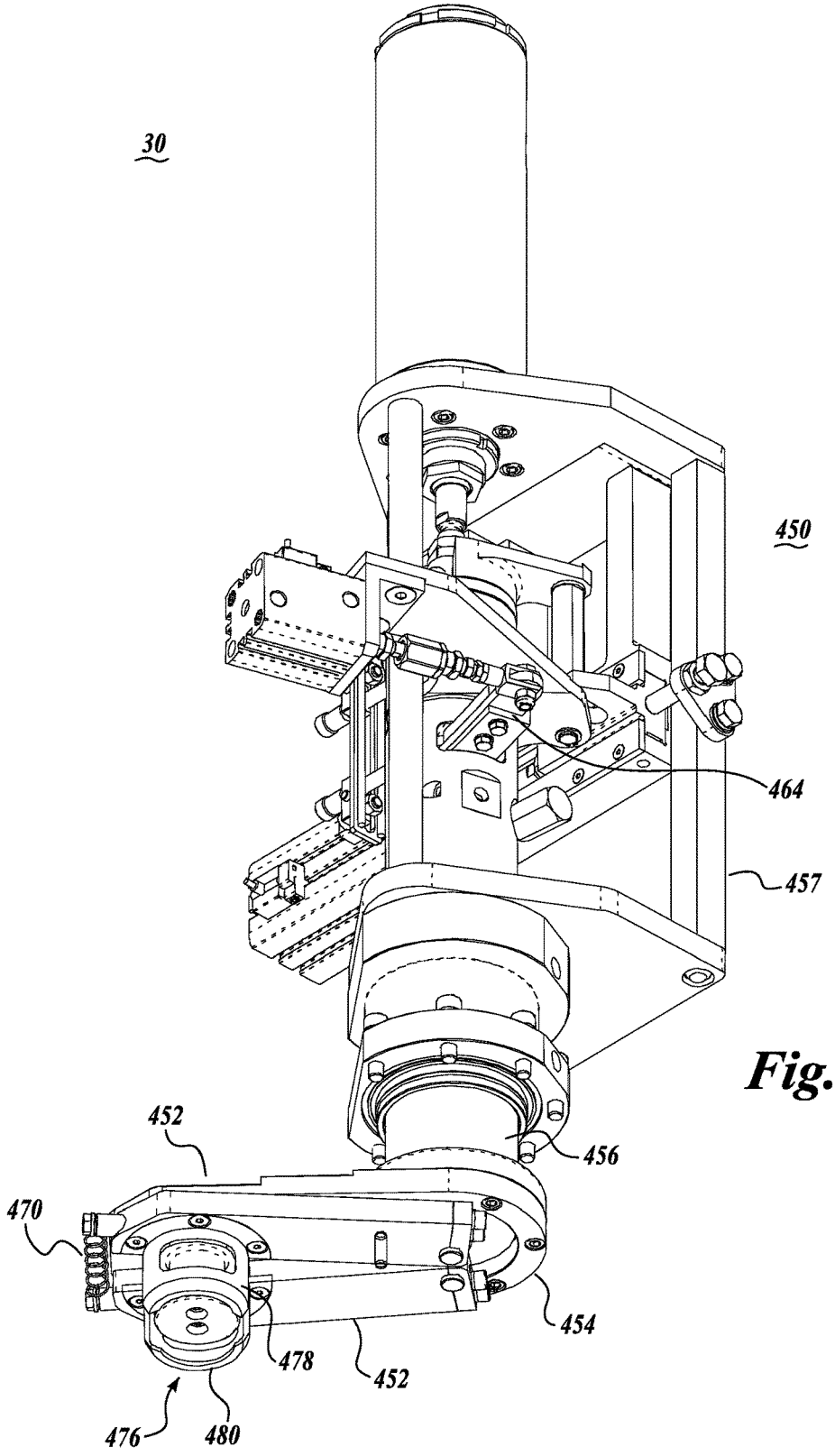
Figure 17:
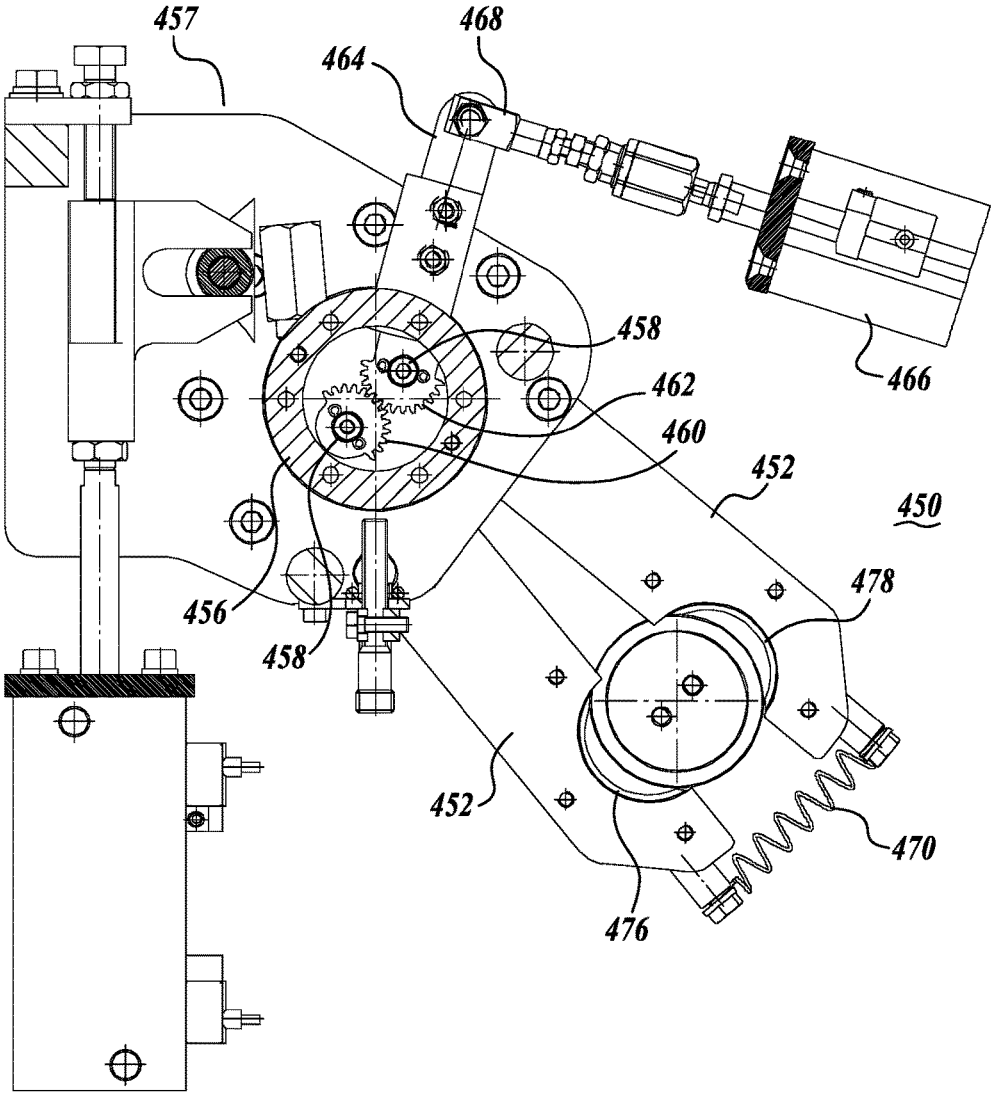
Figure 18:
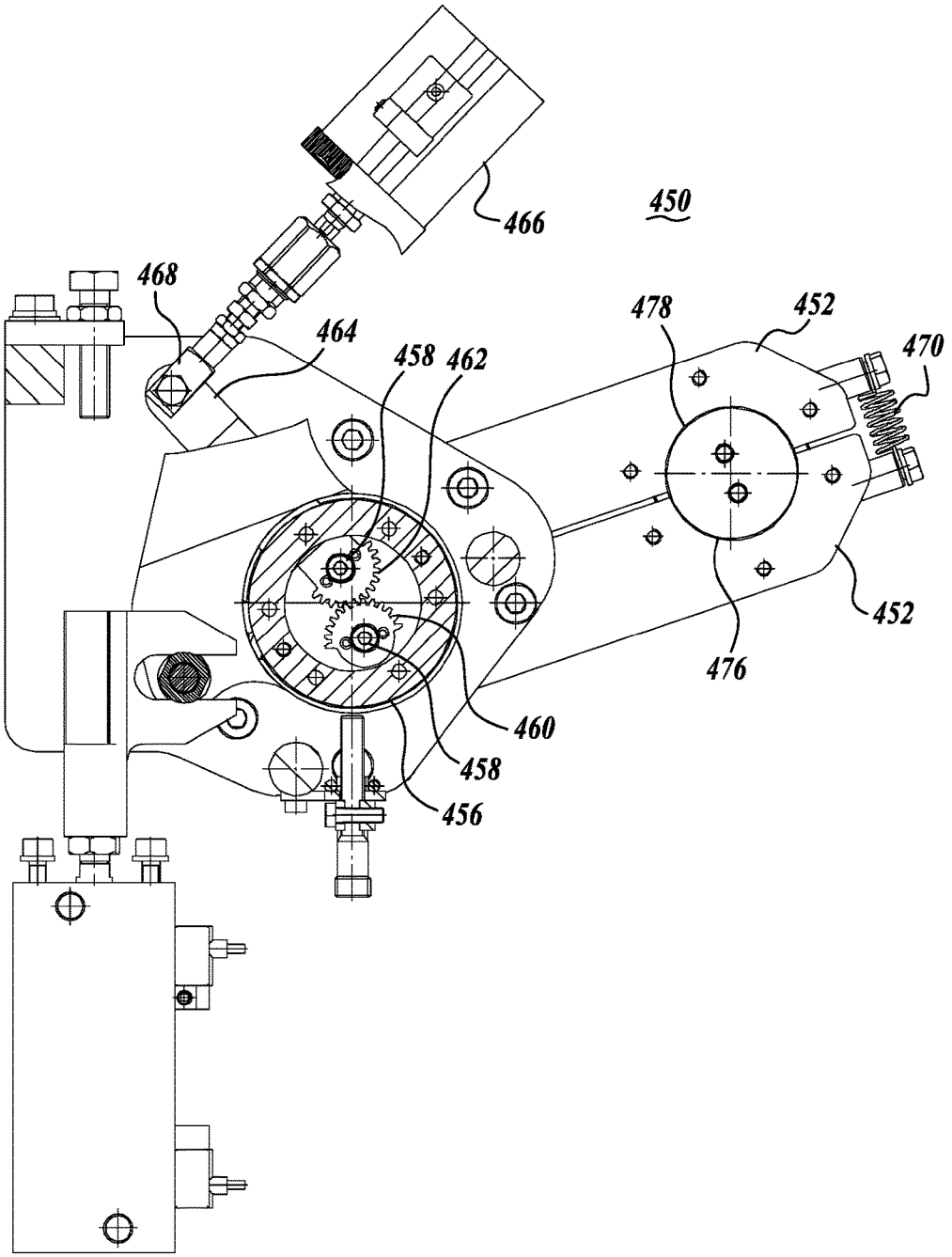

The fitment cap removal/replacement apparatus 450 includes a pair of clamp arms 452 that project from a pivot head 454, located at the lower end of a pivot cylinder 456. The ends of the pivot arms 452 at the pivot head 454 are secured to the lower ends of pivot rods 458 that extend downwardly through the pivot cylinder 456, that extends downwardly from a frame structure 457, see FIG. 17. Segment gears 460 and 462 are attached to the upper ends of the pivot rods 458. The segment gears 460 and 462 mesh with each other, as shown in FIG. 17. The segment gear 462 is attached or integrated into an end portion of a pivot arm 464 that projects outwardly from pivot cylinder 456. The distal end of the pivot arm 464 is connected to a linear actuator 466 via clevis 468 connected between the distal end of pivot arm 464 and a connecting rod extending from actuator 466. It will be appreciated that actuator 466 is operated to control the rotation of clamp arms 452 from an open or spread position, as shown in FIGS. 16 and 17, to a closed position as shown in FIG. 18. An extension spring 470 is connected between the distal end portions of clamp arms 452 to bias the clamp arms in closed position.

As most clearly shown in FIG. 16, an attachment head 476 is mounted near the distal end portions of the clamp arms 452. The attachment head 476 includes two halves, that cooperatively define a generally cylindrical or circular shape. The attachment head 476 includes a generally cylindrical body portion 478 and an inwardly extending flange portion 480 at the lower edge portion of the body portion. The flange portion 480 is sized to underlie the upper rim of the fitment cap, thereby to lift the cap upwardly when removing the cap from the fitment collar. In this regard, the pivot cylinder 456 of the apparatus 450 is moveable vertically relative to frame 457 and also rotatably about the longitudinal axis of the pivot cylinder. This enables the apparatus to be positioned so that the attachment head 476 is positioned over the fitment cap 404 during the cap removal process. As the attachment head 476 is lowered, the clamp arms 452 are spread until the elevation of the attachment head is such that the flange portion 480 is beneath the cover flange of the fitment cap, whereupon the clamp arms are allowed to close over the fitment cap. The attachment head is then raised upwardly via the upward movement of the pivot cylinder 456, and then the pivot cylinder itself is rotated so that the fitment cap is moved out of the vicinity of the fitment. After the flexible bag 400 has been filled, the fitment cap 404 is replaced by reversing the foregoing process. FIG. 7 shows the fitment cap 404 replaced by the apparatus 450.

A fitment plug assembly 500 is provided to close off the bottom of the fitment collar from the interior of the bag 400 at various portions of the filling cycle for the bag 400; for instance, when the fitment is being sterilized, when the fitment cap is being removed and before the fill process starts, and during the process of replacing the fitment cap after the bag has been filled.

Figure 10:
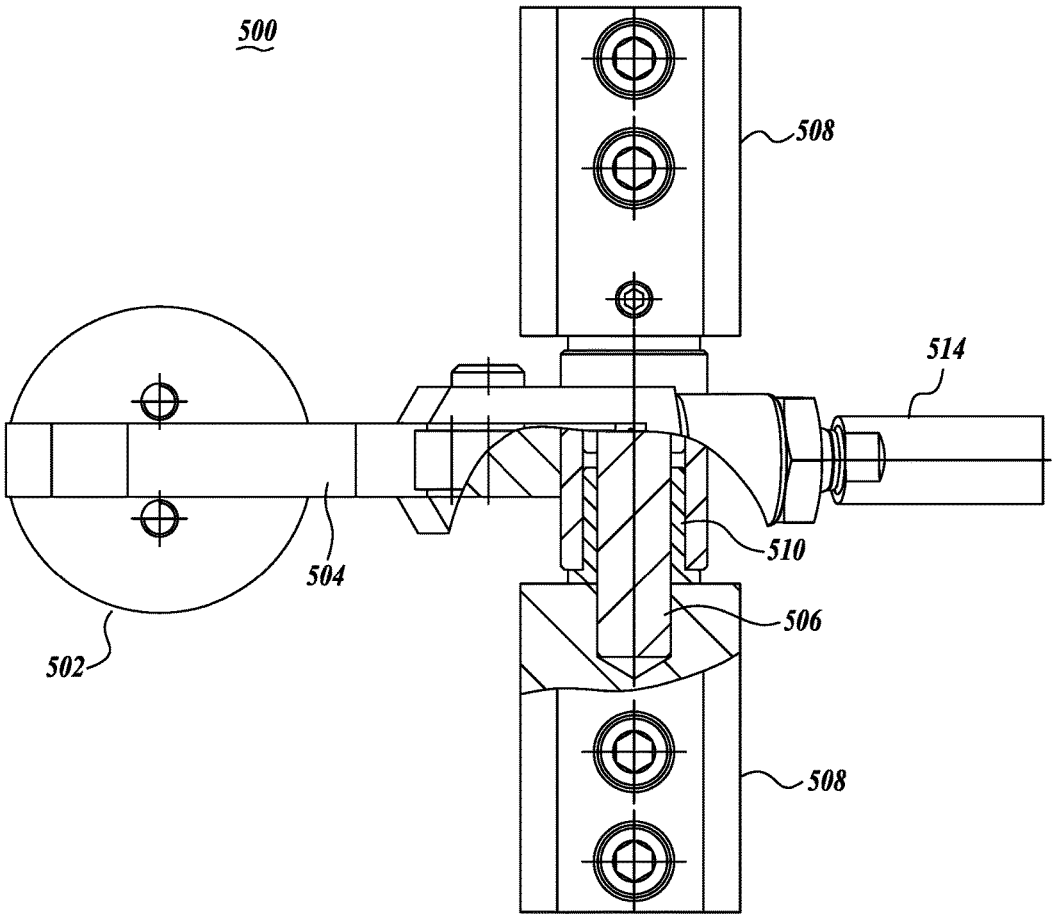

The construction of the fitment plug assembly 500 is most clearly shown in FIGS. 9-12. As shown in these Figures, the plug assembly 500 includes plug 502 mounted on the distal end portion of a pivot arm 504. The opposite end of the pivot arm is rotatably axled on cross pin 506 which spans between, and is held in place by, two spaced-apart mounting brackets 508 that are secured to the underside of the fitment chamber housing 202. A bushing 510 is interposed between the cross pin 506 and a close-fitting cross-bore extending through the pivot arm 504 so that the pivot arm rotates freely relative to the cross pin. A portion of the pivot arm shown in FIG. 10 is broken away to illustrate this construction. The pivot arm 504 includes a transverse lug 512, shown extending downwardly from the pivot arm 504 in FIG. 11. The distal end of an actuator rod 514 is connected to the lug 512 via a clevis 516 engaging through a cross hole formed in the lug. The actuator rod 514 is part of linear actuator 518. The opposite end of the linear actuator includes a pair of spaced-apart mounting ears 520 that are pinned to a bracket 522 depending downwardly from the floor plate structure 64 of the apparatus frame 50.

Figures 11, 12:
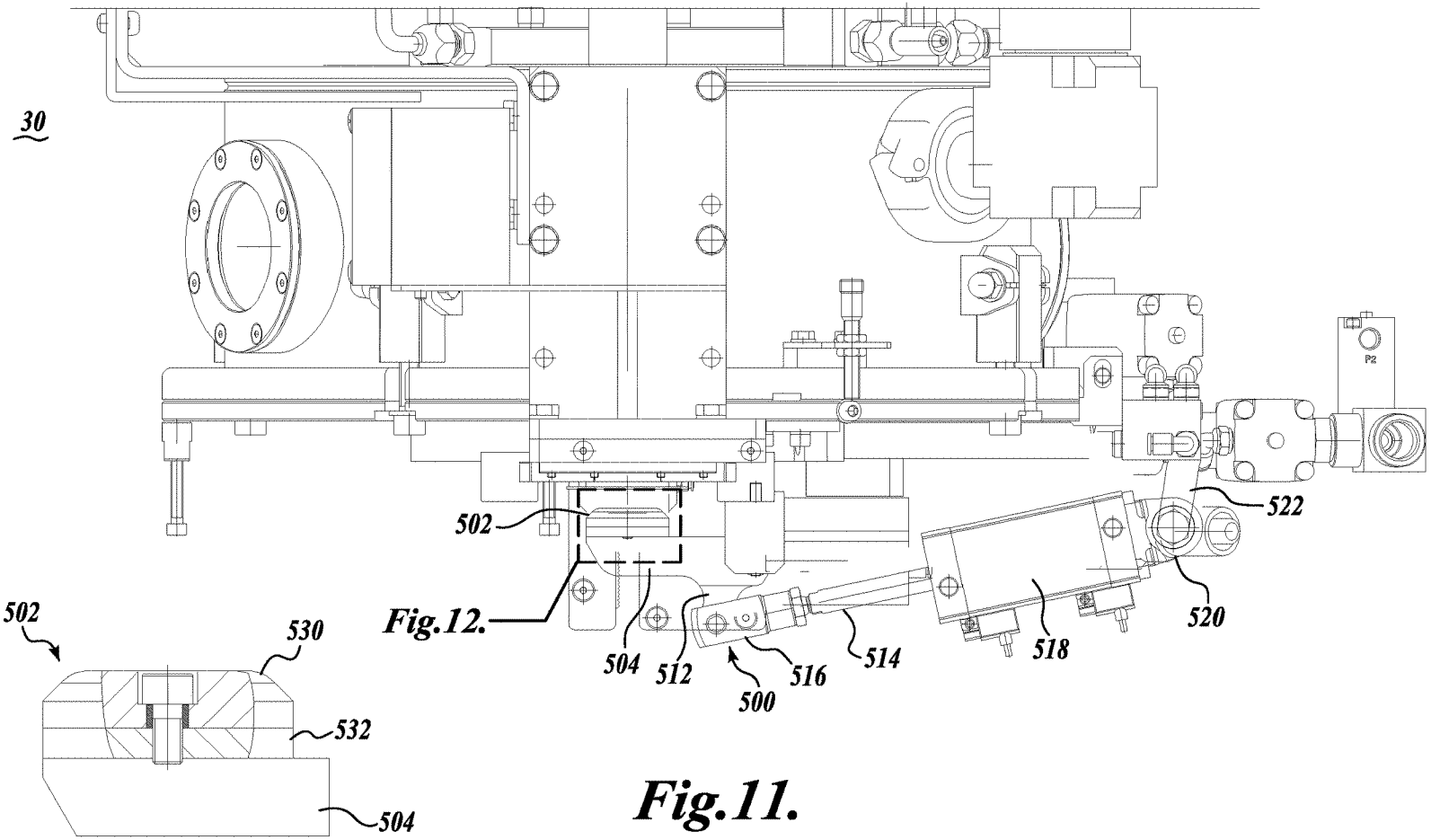

As shown in FIG. 12, the plug 502 is constructed of a resilient upper plug layer 530 and a lower backing layer 532. The upper plug layer is constructed of rubber, synthetic rubber, a resilient plastic material or other durable but resilient material that is capable of sealing against the bottom of collar 408 to form a seal against the collar. To this end, the upper plug layer 530 is chamfered or radiused to provide a relatively tight seal against the lower end of collar 408. The backing layer 532 provides a support for the upper plug layer 530 on the pivot arm 504, which is substantially narrower than the diameter of the upper plug layer 530.

The linear actuator 518 when extended pivots the plug 502 into position against the bottom of the fitment collar 408. In this manner, the plug remains exterior of the bag 400 and thus is not a source of possible contamination with the bag. Moreover, the portion of the bag interposed between the bottom of the collar 408 and the plug 502 can serve as a gasket or seal to positively close off the bottom of the collar 408.

When in such position, the plug assembly 500 is exterior of the bag 400, and thus, part of the bag is disposed between the upper surface of the plug 502 and the bottom of the fitment collar 408. When the actuator 518 is in contracted condition, the plug 502 is rotated away approximately 90 degrees from the fitment chamber 200 and the associated fitment 402, for example, as shown in FIGS. 1, 5, and 6. However, when the plug assembly 500 is in engaged position, the plug assembly closes off the bottom of the fitment collar from the interior of the bag itself. This is important when removing the fitment cap 404 from the fitment collar 408 in preparation to begin filling the bag. By closing off the bottom of the fitment collar with the plug 502, the pressure within the filler chamber 60 is maintained so as to retain the aseptic condition within the pressurized filler chamber. Proof of a positive pressure level in the filler chamber is a regulatory requirement in certain countries for aseptic filler systems. But for the position of the fitment plug 502 at the bottom of the fitment collar, when the fitment cap is removed, the steam or other moisture from the filler chamber would otherwise enter the filler bag and thereby drastically reduce the pressure within the filler chamber.

Figure 8:
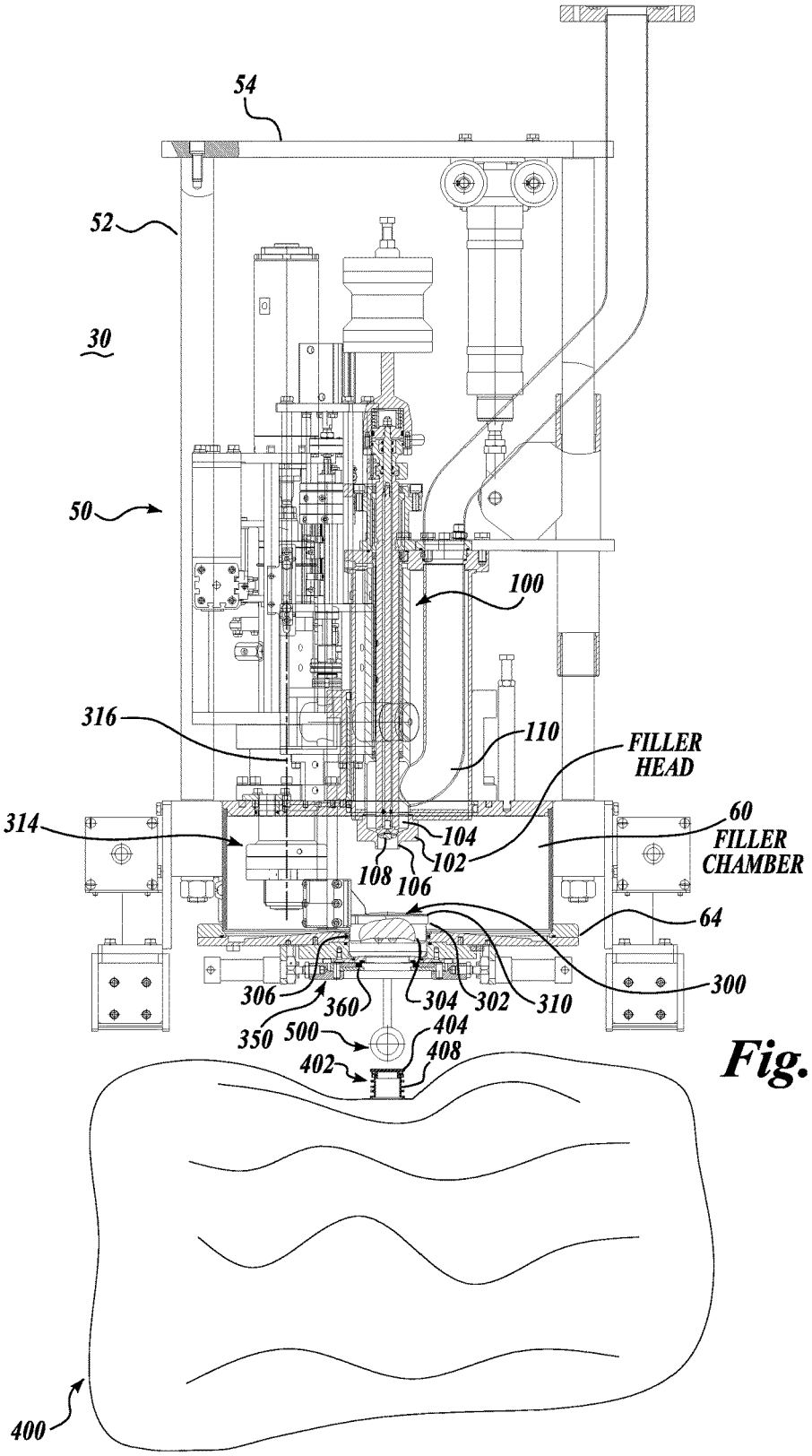
Figure 9:
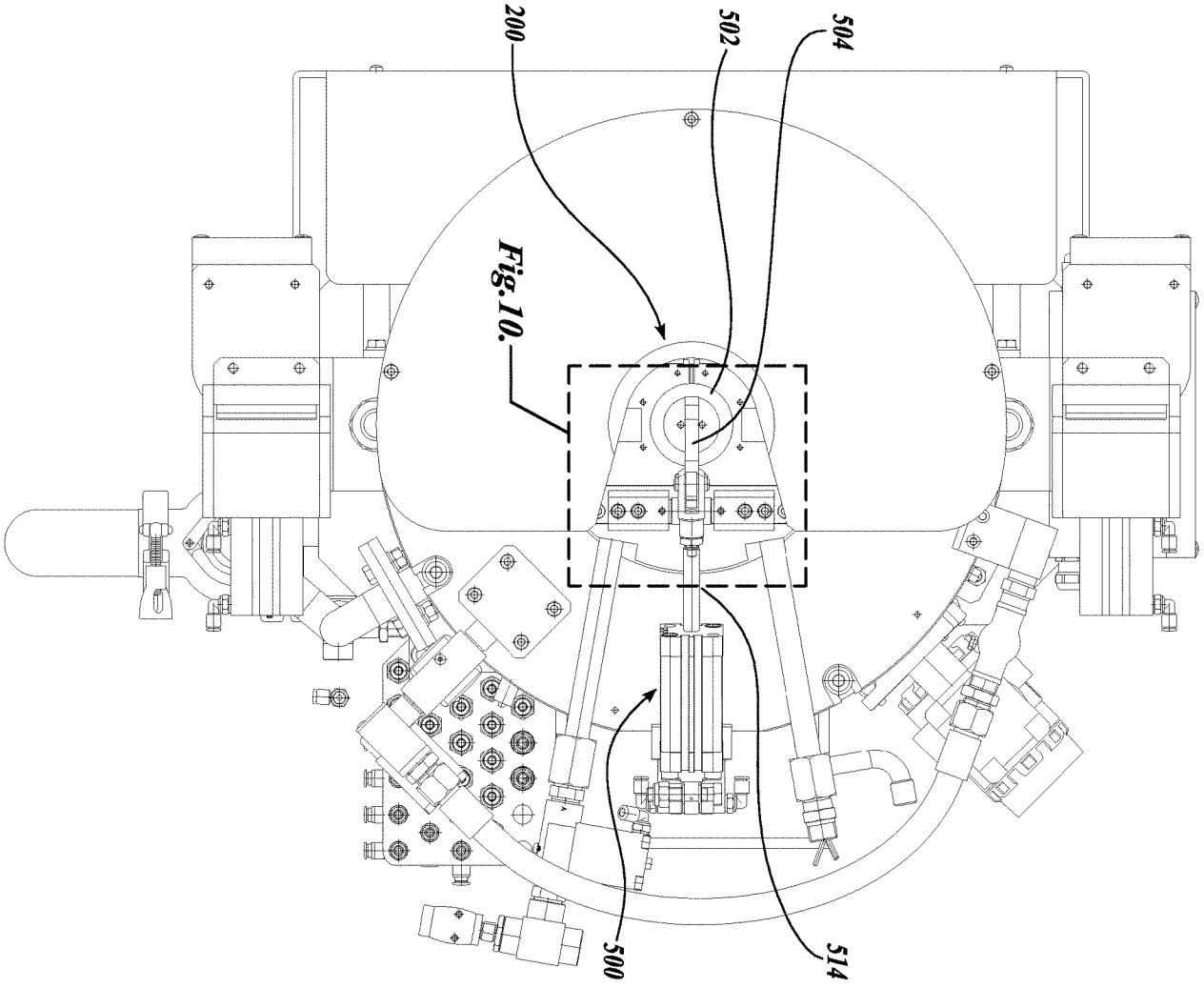

Also, after the bag has been filled and the filler head is being retracted and the fitment cap replaced, the fitment plug is again positioned against the lower end of the fitment collar to isolate or close off the fitment bag from the filler chamber. Since a filled bag, such as bag 400, is not filled to such an extent that there does not remain an empty or unfilled volume at the top of the bag, the engaged fitment plug 502 does not place a significant strain on the bag, even when filled. The positioning of the fitment plug against the lower end of the fitment collar not only helps maintain the positive (over) pressure within the filler chamber, but also prevents undesirable fluids from entering the filler bag. Once the fitment cap has been replaced over the fitment collar, the fitment plug assembly can be retracted so that thereafter, the fitment can be released by the fitment holder assembly 350 and the bag removed from the filler apparatus, as shown in FIG. 8.

The following will briefly describe a fill cycle utilizing the apparatus of the present disclosure. Table A sets forth the positions of filler head assembly 100, filler chamber plug assembly 300, fitment collar holder assembly 350, fitment cap remover/retractor apparatus 450, and fitment plug assembly 500 during the fill cycle.

still closed off by the fill chamber plug assembly 300. During this portion of the fill cycle, steam is introduced into the fitment chamber so as to sterilize the fitment 402.

After the sterilization of the fitment 402 has been completed, the fitment cap 404 is removed using the fitment cap removal/replacement assembly 450. FIG. 3 shows the removal/replacement assembly 450 engaged with the fitment cap 404. As noted above with respect to FIG. 2, the fitment collar 408 is held tightly in place by the fitment holder assembly 350, and the plug 502 of the fitment plug assembly 500 is engaged against the underside of the fitment collar 408. The operation of the fitment cap removal/replacement assembly has been described above.

Next in the fill cycle, FIG. 4 shows the fitment cap 404 removed and the fitment cap removal/replacement apparatus pivoted to temporarily position the fitment cap away from the fitment chamber 200. The plug 502 of the fitment plug assembly 500 is retained tightly against the underside of the fitment collar, thereby preventing loss of pressure within the fill chamber and also preventing undesirable fluids from entering the bag 400.

TABLE A

POSITION OF FILLER SYSTEM ELEMENTS DURING FILL CYCLE

| Fill Cycle | FIGS. | Fill Chamber Plug Assembly 300 | Filler Head Assembly 100 | Fitment Cap Remover/ Retractor 450 | Fitment Collar Holder Assembly 350 | Fitment Plug Assembly 500 |
|---|---|---|---|---|---|---|
| 1. Fill Chamber in Ready Condition | 1 | In Place - Closing off Fill Chamber | Retracted | Retracted | Retracted | Retracted |
| 2. Fill Bag in Place - Sterilizing of Fitment Closure | 2 | In Place - Closing off Fill Chamber | Retracted | Retracted | Engaged with Fitment Collar | In place against Fitment Collar |
| 3. Fitment Cap Removal | 3 | Removed and Retracted | Retracted | Engaged with Fitment Cap for Removal | Engaged with Fitment Collar | In place against Fitment Collar |
| 4. Fitment Cap Removed | 4 | Removed and Retracted | Retracted | Retracted | Engaged with Fitment Collar | In place against Fitment Collar |
| 5. Filling of Bag | 5 & 6 | Removed and Retracted | Engaged with Fitment Collar | Retracted | Engaged with Fitment Collar | Retracted |
| 6. Bag Filled. Replacement of Fitment Cap | 7 | Removed and Retracted | Retracted | Engaged with Fitment Cap for placement | Engaged with Fitment Collar | In place against Fitment Collar |
| 7. Fill Completed. Bag Detached from Fill System. | 8 | In Place - Closing off Fill Chamber | Retracted | Retracted | Retracted | Retracted |

Beginning at FIG. 1, the filler apparatus 30 is shown in standby or ready condition. In this regard, the bottom opening of the fill chamber is closed by the fill chamber plug assembly 300 inserted into the center opening formed in the floor plate structure 64. The filler head assembly 100 is retracted in upward position. Also, the fitment plug assembly 500 is shown in retracted position, and thus swung away from the fitment chamber 200.

Next, as shown in FIG. 2, the fitment 402 is held in place within the fitment chamber 200 by the fitment holder assembly 350. The fitment plug assembly 500 is in engaged position so that the fitment plug 502 bears against the bottom of the fitment collar 408. The top of the fitment chamber is FIGS. 5, 6, and 14 illustrate the filling of the bag 400 with desired liquid food product. To this end, the filler head assembly 100 is extended downwardly so that the nipple 106 is disposed within the interior of the fitment collar 408. Food products from product inflow tube 110 can flow into and through the head structure 102 and then downwardly through the nipple 106, through the fitment collar 408, and into the interior of the bag 400. It will be appreciated that in this portion of the fill cycle a fitment plug assembly 500 is retracted so as to not obstruct the flow of the food product through the fitment collar.

Once the bag 400 has been filled, the filler head assembly 100 is retracted upwardly to disengage the nipple 106 from the fitment collar, see FIG. 7. At this juncture, the fitment cap 404 is replaced by the fitment cap removal and replacement apparatus 450. The operation of the apparatus 450 is described above. During this portion of the fill cycle, the fitment plug assembly is in engaged position so that the plug 502 is against the underside of the fitment collar 408, thereby to prevent loss of pressure within the fitment chamber as well as prevent undesirable fluids from entering the bag 400 after the filler head assembly 100 has been retracted and before the fitment cap 404 has been placed back over the fitment collar.

Lastly, once the fitment cap 404 has been replaced, the fitment 402 can be released from the fitment holder assembly 350. Prior to such release, the fitment plug assembly 500 is retracted so as not to hinder the removal of the fitment from the fitment holder assembly 350. The filled bag 400 is removed from the filler apparatus 30, as illustrated in FIG. 8. It will be appreciated that steam can be introduced into the fitment chamber 200 after removal of the bag 400 to clean the fitment chamber if necessary.

The operation of the described fill cycle is controlled and sequenced by a control system that is capable of actuating the various systems and components of the fill system described above. The control system includes software that can be operated and manipulated to adjust the fill system 30 and fill cycle to accommodate the particular food or other product being delivered to the filler bag 400, as well as the size and other aspects of the filler bag. Although not shown, a user interface may be provided that can be used to operate, manipulate and/or adjust the fill system 30 and fill cycle of the present disclosure.

While illustrative embodiments have been illustrated and described, it will be appreciated that various changes can be made therein without departing from the spirit and scope of the invention. In this regard, although the fill system and process of the present disclosure are specifically advantageous for use with low acid food packaging, the system and process can be used with aseptically filling flexible containers with all manner of flowable food products. The fill system of the present disclosure can also be used with the aseptic filling of flexible containers with flowable products in addition to food products, for example, cosmetic products or medications.

The embodiments of the invention in which an exclusive property or privilege is claimed are defined as follows:

1. An aseptic filler apparatus operable in a fill cycle to fill flexible bags with food products, the flexible bags fitted with a fitment composed of a collar nominally in food flow communication with the flexible bag and a removable cap engageable with the collar, the filler apparatus comprising:

a. An enclosed filler chamber comprising a top ceiling structure spanning across a top of the filler chamber and a bottom floor structure spanning across a bottom of the filler chamber, the floor structure defining an opening extending therethrough;

b. A filler head disposed in the filler chamber to direct food products into the flexible bag through the fitment, the filler head movable downward in the filler chamber and through the bottom floor structure opening to engage the fitment to fill the flexible bags with food products and movable upward in the filler chamber to disengage from the fitment when not filling the flexible bag with the food products;

c. A fitment chamber positioned beneath the bottom floor structure of the filler chamber, the fitment chamber comprising a top section in communication with the bottom floor structure opening, and extending below, the filler chamber bottom floor structure, an internal wall structure extending downwardly from the filler chamber bottom floor structure to an elevation below the filler chamber bottom floor structure, the fitment chamber positioned to receive the filler head when the filler head is engaged with the fitment, the fitment chamber being of a substantially smaller volume than the volume of the filler chamber;

d. A holder assembly to releasably hold the fitment stationary within the fitment chamber and at an elevation below the bottom floor structure of the filler chamber during the filling of the flexible bag, the holder assembly located below the bottom floor structure of the filler chamber;

A powered closure system to selectively close the opening of bottom floor structure while the fitment is held stationary within the fitment chamber; and f. A fitment plug assembly moveable between an actuated position to bear against the fitment collar to block communication between the filler chamber and the interior of the flexible bag during desired portions of the fill cycle and a retracted position wherein the fitment plug assembly is spaced away from the fitment collar to not hinder food flow communication between the filler chamber and the interior of the flexible bag.

2. The filler apparatus according to claim 1, wherein the fitment plug assembly is positioned externally of the flexible bag.

3. The filler apparatus according to claim 2, wherein when the fitment plug assembly is in actuated position, a portion of the flexible bag is interposed between the fitment collar and the fitment plug.

4. The filler apparatus according to claim 1, wherein the fitment plug assembly when in actuated position closes off the fitment collar at the intersection of the fitment collar and the flexible bag, thereby to prevent communication between the filler chamber and the interior of the bag.

5. The filler apparatus according to claim 1, wherein the fitment plug assembly comprises an actuator assembly for moving the fitment plug between the actuated position and the retracted position of the fitment plug assembly, the actuator assembly comprising a pivot arm for supporting the fitment plug and an actuator for moving the pivot arm between the actuated position of the fitment plug assembly and the retracted position of the fitment plug assembly.

6. The filler apparatus according to claim 1, further comprising a fitment cap removal and replacement apparatus, the cap removal and replacement apparatus positionable within the fitment chamber to engage with the fitment cap to remove the fitment cap from the fitment collar, thereby to provide access to the fitment collar during filling of the flexible bag by the filler head, and replacement of the fitment cap into engagement with the fitment collar.

7. The filler apparatus according to claim 1, further comprising:

a source of steam;

a steam delivery system for directing the steam from the steam source to an inlet within the fitment chamber, the steam collected within the fitment chamber; and a steam removal system for directing steam out of the fitment chamber.

8. The filler apparatus according to claim 1, wherein the closure system comprises a plug structure to engage snugly down into the fitment chamber to close the opening of the bottom floor structure of the filler chamber, without the need to continually apply downward pressure on the plug structure.

9. The filler apparatus according to claim 1, wherein the fitment chamber is defined at least in part by a housing structure located under the bottom floor structure of the filler chamber.

10. The filler apparatus according to claim 9, wherein the fitment chamber further comprises a cleaning fluid inlet and a cleaning fluid outlet.

11. The filler apparatus according to claim 9, wherein the closure system extends downwardly into the fitment chamber when closing the opening of the bottom floor structure of the filler chamber.

12. An apparatus for aseptically filling flexible bags with a flowable food product, the bags fitted with a fitment composed of a collar nominally in food product flow communication with the interior of the flexible bag, and a cap engageable with the collar to close off the collar, the apparatus comprising:

a. a filler chamber defined by a top ceiling structure spanning across a top of the filler chamber and a bottom floor structure spanning across a bottom of the filler chamber, the bottom floor structure defining an opening extending therethrough;

b. a filler head disposed in the filler chamber, the filler head in communication with a supply of flowable food product, the filler head configured to direct flowable food product to the fitment collar, the filler head movable downward in the filler chamber and through the bottom floor structure opening to engage the fitment to fill the flexible bags with food products and movable upward in the filler chamber to disengage from the fitment when not filling the flexible bag with the food products;

c. a fitment chamber positioned below the filler chamber, the fitment chamber:

having a top section in communication with the filler chamber bottom floor structure opening;

extending below the filler chamber bottom floor structure;

comprising an internal wall structure extending downwardly from the filler chamber bottom floor structure to an elevation below the filler chamber bottom floor structure; and positioned to receive the filler head when the filler head is engaged with the fitment;

d. a fitment holder for releasably holding the fitment collar stationary within the fitment chamber, and below the bottom floor structure of the filler chamber, during filling of the bag via the filler head, the fitment holder located below the bottom floor structure of the filler chamber;

a powered closure system to selectively close the opening of the bottom floor structure of the filler chamber while the fitment is held stationary within the fitment chamber; and f. an activatable fitment closure apparatus for selectively closing off the fitment collar, thereby to prevent communication between the filler chamber and the interior of the flexible bag before and after the flowable food product has been introduced into the flexible bag.

13. The improvement according to claim 12, wherein the fitment holder holds the fitment in communication with the filler chamber.

14. The improvement according to claim 12, further comprising a steam inlet within the fitment chamber for connecting the fitment chamber to a source of steam, and a steam outlet within the fitment chamber for expelling steam from the fitment chamber.

15. The improvement according to claim 12, further comprising a fitment cap removal/replacement apparatus, the removal/replacement apparatus positionable within the fitment chamber to engage with the fitment cap to selectively remove the fitment cap from the fitment collar, thereby providing access to the fitment collar, and for replacement of the fitment cap engaged with the fitment collar to close off access to the fitment collar.

16. The improvement according to claim 12, wherein the fitment closure apparatus is disposed external to the flexible bag.

17. The improvement according to claim 12, wherein the fitment closure apparatus comprises a fitment plug and an actuator assembly for moving the fitment plug between an actuated position, wherein said fitment plug is adjacent the fitment collar at the intersection of the fitment collar and the flexible bag, and a retracted position, wherein the fitment plug is retracted away from the fitment collar, the fitment plug configured to present a barrier to the end of the fitment collar at the intersection of the fitment collar and the flexible bag.

18. The improvement according to claim 17, wherein when the fitment closure apparatus is in an activated position, a portion of the flexible bag is disposed between the adjacent end of the collar and the fitment plug.

19. The improvement according to claim 17, wherein the actuator assembly comprises a pivot arm for supporting the fitment plug and an actuator for pivoting the pivot arm between an activated position, wherein the fitment plug presents the barrier to the fitment collar, and a retracted position wherein the fitment plug is retracted away from the fitment collar, thereby not hindering communication between the filler chamber and the interior of the bag.

20. The filler apparatus according to claim 12, wherein the fitment chamber is defined at least in part by a housing structure located under the bottom floor structure of the filler chamber.

21. The filler apparatus according to claim 20, wherein the fitment chamber further comprises a cleaning fluid inlet and a cleaning fluid outlet.

22. The filler apparatus according to claim 20, wherein the closure system extends downwardly into the fitment chamber when closing the opening of the bottom floor structure of the filler chamber.

* * * * *